US010842223B2

(12) United States Patent
Amis et al.

(10) Patent No.: US 10,842,223 B2
(45) Date of Patent: Nov. 24, 2020

(54) FOOTWEAR WITH INTERNAL CHASSIS AND/OR INDEXED SOCK LINER

(71) Applicant: NIKE, Inc., Beaverton, OR (US)

(72) Inventors: Sam Amis, Portland, OR (US); Michael S. Amos, Beaverton, OR (US); John Hurd, Lake Oswego, OR (US); James Molyneux, Portland, OR (US); Thomas J. Rushbrook, Portland, OR (US); Timothy J. Smith, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 270 days.

(21) Appl. No.: 15/402,496

(22) Filed: Jan. 10, 2017

(65) Prior Publication Data

US 2017/0202301 A1 Jul. 20, 2017

Related U.S. Application Data

(60) Provisional application No. 62/279,547, filed on Jan. 15, 2016.

(51) Int. Cl.
*A43B 13/14* (2006.01)
*A43B 17/00* (2006.01)
(Continued)

(52) U.S. Cl.
CPC ..... *A43B 13/141* (2013.01); *A43B 5/02* (2013.01); *A43B 7/141* (2013.01); *A43B 7/143* (2013.01);
(Continued)

(58) Field of Classification Search
CPC ... A43B 13/141; A43B 13/188; A43B 13/186; A43B 13/12; A43B 13/04; A43B 13/00;
(Continued)

(56) References Cited

U.S. PATENT DOCUMENTS 3,517,928 A * 6/1970 Shanahan ..... A43B 3/0031 36/132
4,223,455 A * 9/1980 Vermeulen ..... A43B 13/20 36/29

(Continued)

FOREIGN PATENT DOCUMENTS

WO 2013192259 A1 12/2013

OTHER PUBLICATIONS

Notification of Transmittal of the International Search Report and the Written Opinion of the International Searching Authority, or the Declaration of PCT/US2017/013343 dated Apr. 26, 2017.

*Primary Examiner* — Shaun R Hurley
*Assistant Examiner* — Bao-Thieu L Nguyen
(74) *Attorney, Agent, or Firm* — Banner & Witcoff, Ltd.

(57) ABSTRACT

A chassis for an article of footwear may include a base and a frame attached to a top side of the base. The frame may include a network of interconnected walls defining a plurality of cells, each of at least a portion of the cells having a bottom at least partially closed by an underlying portion of the base. A bottom of the base may be fixed with respect to a plantar section of an upper. A sock liner may be indexed to the chassis or to another footwear support structure. The sock liner may have downwardly-extending tabs configured to rest in cells of the chassis or in other cavities of a support structure.

27 Claims, 38 Drawing Sheets

(51) Int. Cl.

| | |
|---|---|
| ***A43B 17/14*** | (2006.01) |
| ***A43B 9/00*** | (2006.01) |
| ***A43B 7/14*** | (2006.01) |
| ***A43B 13/16*** | (2006.01) |
| ***A43B 13/12*** | (2006.01) |
| ***A43B 13/22*** | (2006.01) |
| ***A43B 5/02*** | (2006.01) |
| ***A43B 13/04*** | (2006.01) |
| ***A43B 13/18*** | (2006.01) |
| ***A43C 15/16*** | (2006.01) |

(52) U.S. Cl.
CPC ..... *A43B 9/00* (2013.01); *A43B 13/04* (2013.01); *A43B 13/12* (2013.01); *A43B 13/122* (2013.01); *A43B 13/16* (2013.01); *A43B 13/186* (2013.01); *A43B 13/188* (2013.01); *A43B 13/223* (2013.01); *A43B 17/006* (2013.01); *A43B 17/14* (2013.01); *A43C 15/16* (2013.01)

(58) Field of Classification Search
CPC ..... A43B 13/14; A43B 13/122; A43B 13/38; A43B 17/006; A43B 17/00
See application file for complete search history.

(56) References Cited

U.S. PATENT DOCUMENTS 4,658,515 A * 4/1987 Oatman ..... A43B 17/14 36/2.6
4,739,765 A * 4/1988 Sydor ..... A43B 7/142 36/155
4,742,625 A * 5/1988 Sydor ..... A43B 17/18 36/11.5
5,042,175 A * 8/1991 Ronen ..... A43B 13/182 36/15
5,367,791 A * 11/1994 Gross ..... A43B 13/181 36/25 R
5,584,130 A * 12/1996 Perron ..... A43B 7/1455 36/3 B
5,619,809 A * 4/1997 Sessa ..... A43B 7/06 36/28
6,009,637 A * 1/2000 Pavone ..... A43B 13/14 36/28
6,158,149 A * 12/2000 Rudy ..... A43B 7/144 36/28
6,266,896 B1 * 7/2001 Liu ..... A43B 13/12 36/28
6,367,172 B2 * 4/2002 Hernandez ..... A43B 1/0009 36/103
6,560,900 B2 * 5/2003 Bray, Jr. ..... A43B 3/108 12/142 B
6,564,476 B1 * 5/2003 Hernandez ..... A43B 1/0009 36/103
6,655,048 B2 * 12/2003 Moretti ..... A43B 7/08 36/29
6,775,926 B1 * 8/2004 Huang ..... A43B 7/081 36/3 B
6,915,596 B2 * 7/2005 Grove ..... A43B 13/223 36/100
6,973,746 B2 * 12/2005 Auger ..... A43B 1/0072 36/128
7,134,223 B2 * 11/2006 Ganon ..... A43B 9/06 36/12
7,140,129 B2 * 11/2006 Newson ..... A43B 5/18 36/100
7,143,530 B2 * 12/2006 Hudson ..... A43B 1/0072 36/128
7,406,781 B2 * 8/2008 Scholz ..... A43B 3/24 36/134
8,241,450 B2 * 8/2012 Hensley ..... A43B 13/20 156/145
8,474,155 B2 * 7/2013 McDonald ..... A43B 1/0063 36/102
8,713,819 B2 * 5/2014 Auger ..... A43B 5/02 36/102
8,863,408 B2 * 10/2014 Schindler ..... A43B 13/20 36/29
9,204,680 B2 * 12/2015 Hoffer ..... A43B 1/0009
9,486,036 B1 * 11/2016 Douglas ..... A43B 9/00
9,788,605 B2 * 10/2017 Reuben ..... A43B 13/42
9,839,255 B2 * 12/2017 Adami ..... A43B 5/02
2002/0162246 A1 * 11/2002 Mayer ..... A43B 7/141 36/30 R
2005/0016029 A1 * 1/2005 Auger ..... A43B 1/0072 36/134
2005/0044745 A1 * 3/2005 Pfander ..... A43B 1/0009 36/3 B
2005/0188562 A1 9/2005 Clarke et al.
2005/0198868 A1 * 9/2005 Scholz ..... A43B 3/24 36/67 D
2005/0262736 A1 * 12/2005 Peoples ..... A43B 7/144 36/44
2006/0016099 A1 * 1/2006 Marco ..... A43B 7/1435 36/43
2007/0277401 A1 * 12/2007 Young-Chul ..... A43B 13/12 36/30 R
2008/0168681 A1 * 7/2008 Andersen ..... A43B 3/0047 36/100
2009/0151093 A1 * 6/2009 Schindler ..... A43B 13/12 12/146 B
2010/0050471 A1 * 3/2010 Kim ..... A43B 7/081 36/29
2011/0010964 A1 * 1/2011 Hardy ..... A43B 13/36 36/103
2011/0265352 A1 * 11/2011 Lin ..... A43B 7/088 36/3 B
2012/0266492 A1 * 10/2012 Youngs ..... A43B 7/34 36/83
2012/0317843 A1 * 12/2012 Bove ..... A43B 1/0054 36/25 R
2013/0000157 A1 * 1/2013 Wu ..... A43B 13/12 36/30 A
2013/0019499 A1 * 1/2013 Hsu ..... A43B 17/006 36/44
2013/0104419 A1 * 5/2013 Horesh ..... A43B 7/1425 36/43
2013/0125416 A1 * 5/2013 Hoffer ..... A43B 1/0009 36/83
2015/0096199 A1 * 4/2015 Cavaliere ..... A43B 13/12 36/103
2015/0223564 A1 * 8/2015 Peyton ..... A43B 13/20 36/29
2015/0250262 A1 9/2015 Khaitan et al.
2016/0206046 A1 * 7/2016 Cross ..... A43B 1/04
2016/0295959 A1 * 10/2016 Dyer ..... A43B 13/223
2016/0366973 A1 * 12/2016 Wu ..... A43B 7/141
2017/0172251 A1 * 6/2017 Douglas ..... A43B 9/00

* cited by examiner

FOOTWEAR WITH INTERNAL CHASSIS AND/OR INDEXED SOCK LINER

CROSS REFERENCE TO RELATED APPLICATION

This application claims priority to U.S. provisional patent application No. 62/279,547, titled "Footwear With Internal Chassis and/or Indexed Sock Liner" and filed Jan. 15, 2016. Application No. 62/279,547, in its entirety, is incorporated by reference herein.

BACKGROUND

Conventional articles of footwear generally include an upper and a sole structure. The upper provides a covering for the foot and securely positions the foot relative to the sole structure. The sole structure is secured to the upper and is configured so as to be positioned between the foot and the ground when a wearer is standing, walking or running. The sole structure may be used to provide support for the wearer during various types of movements and may include elements (e.g., downwardly-projecting studs) to increase traction. Different sports and other physical activities cause differing patterns and/or intensities of forces on a foot of a participant.

BRIEF DESCRIPTION OF THE DRAWINGS

Some embodiments are illustrated by way of example, and not by way of limitation, in the figures of the accompanying drawings and in which like reference numerals refer to similar elements.

DETAILED DESCRIPTION

Figure 1A:
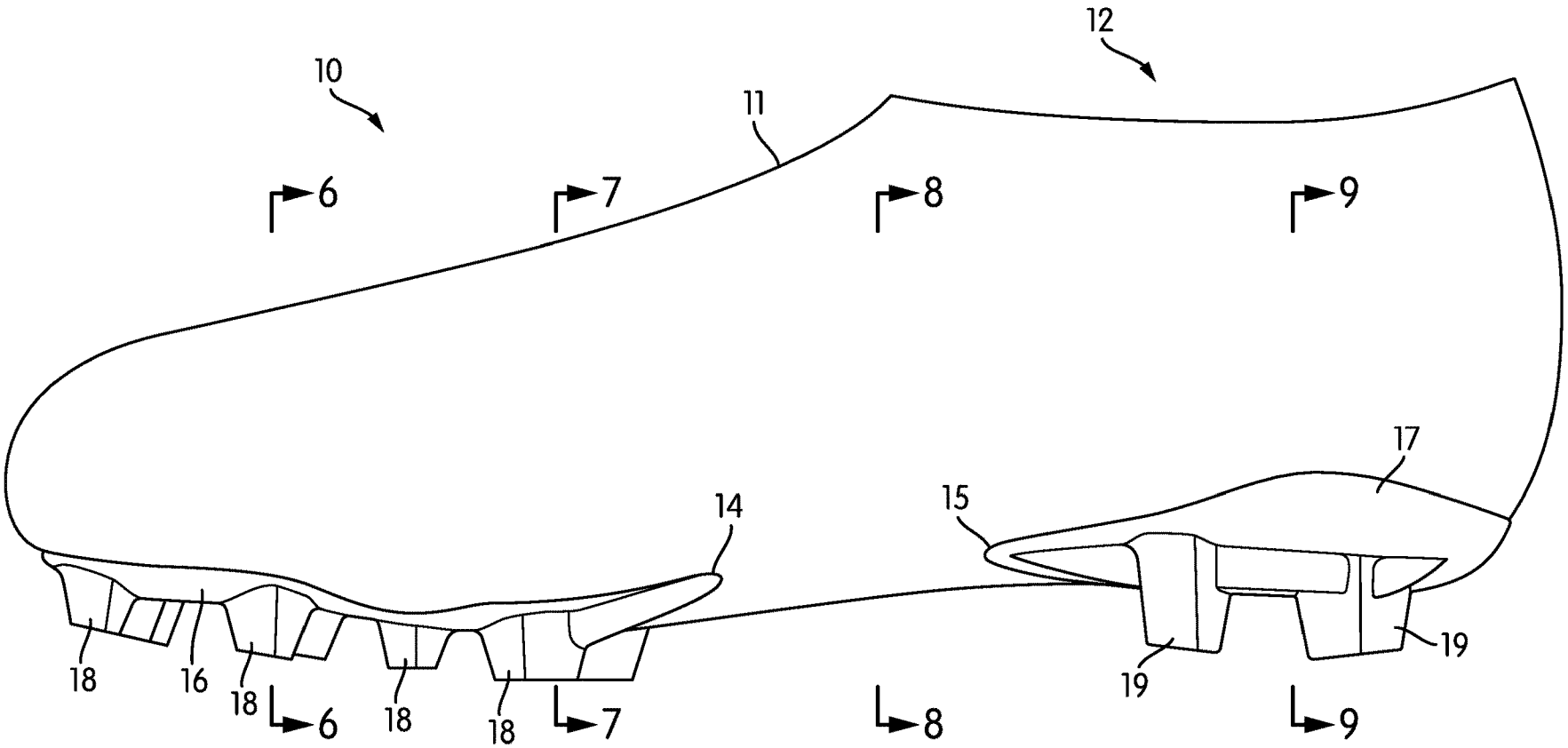
FIG. 1A is a medial side view of a shoe according to some embodiments.

Different sports and other physical activities cause differing patterns and/or intensities of forces on a foot of a participant. A stiffness profile that is beneficial in a sole structure of a shoe for one sport or activity may be less beneficial (or perhaps even harmful) in a sole structure of a shoe for a different sport or activity. Applicant has determined that footwear sole structures having configurations that permit adaptation to different types of sports or activities would be beneficial.

In at least some embodiments, a sole structure for an article of footwear has a configuration that facilitates design modifications to tune a stiffness profile for a particular sport or activity. A first part of the sole structure may comprise a chassis. The chassis may include a frame and a base. The frame may include walls that define cells. At least some of the cells may varied with respect to at least one of size, shape, orientation, and spacing, and/or at least some of the walls may be varied with respect to wall height and wall thickness, so as to define one or more regions and/or directions of increased stiffness. The base may have a shape corresponding to at least a portion of a footwear sole. The base may be attached to the bottom of the frame and may provide a surface to which an upper may be attached. Utilizing this general configuration of a frame and base, sole structures for different activities can readily be designed by selecting sizes, shapes, and/or arrangements of cells, and/or height and/or thickness of walls in various regions, to achieve a desired combination of stiffness in some regions and/or flexibility in other regions.

The accompanying drawings show a sole structure designed for footwear worn by a participant in the sport of international style football, which sport is also known as soccer. Unless otherwise indicated, "football" as used herein refers to international style football. Other embodiments include sole structures and footwear intended for use in other sports or activities (e.g., American style football, rugby, or other sports), and which may include different stiffness profiles.

In some embodiments, a shoe may include an upper and a chassis. The upper may include a plantar section, side sections, and a dorsal section, and the plantar, side and dorsal sections may define a void. The chassis may include a base and a frame. The chassis may be located in a bottom of the void, and a bottom side of the base may be fixed relative to a top surface of the plantar section. The frame may be disposed at a top side of the base. The frame may include a network of interconnected walls defining a plurality of cells, each of at least a portion of the cells having a bottom at least partially closed by an underlying portion of the base.

In some embodiments, a chassis for an article of footwear may include a base and a frame. The base may have a peripheral edge, and the peripheral edge may have a footwear sole shape. For example, a footwear sole shape may have a heel region, a midfoot region, and a forefoot region, a heel end at a rear-most part of the heel region, a toe end at a forward-most part of the forefoot region, a medial side, and a lateral side. The heel region may be narrower than a central portion of the forefoot region. A path from the heel end to the toe that remains generally equidistant from the medial and lateral sides may have a gentle curve toward the medial side. The forefoot region may have a rounded taper toward the toe end. Optionally the shape may be pinched inward on the medial and/or lateral sides in the midfoot region. The frame may be disposed at a top side of the base and may include a network of interconnected walls defining a plurality of cells. Each of at least a portion of the cells may have a bottom at least partially closed by an underlying portion of the base. A first set of the cells may be located in at least a heel region. Each of the cells of the first set may be oriented with its major axis pointing forward and laterally. A second set of the cells may be located in at least a portion of a forefoot region. Each of the cells of the second set may be oriented with its major axis pointing forward and medially.

In some embodiments, a shoe may include an upper, a support surface, and a sock liner. The upper may include a plantar section, side sections, and a dorsal section, and the plantar, side and dorsal sections may define a void. The support surface may be located in a bottom of the void and may have a top side. The support surface top side may have a plurality of upwardly open cavities formed therein. The sock liner may also be located within the void and may rest on the top side of the support surface. The sock liner may be indexed to the support surface. For example, a bottom of the sock liner may include downwardly extending tabs. Each of the tabs may extend into a corresponding one of the cavities.

In at least some embodiments a method for fabricating a shoe may include a step of bonding a plantar portion of an upper to a bottom side of a chassis having a base and a frame attached to a top side of the base, the base comprising a network of interconnected walls defining a plurality of cells, each of at least a portion of the cells having a bottom at least partially closed by an underlying portion of the base.

Additional embodiments are described herein.

To assist and clarify subsequent description of various embodiments, various terms are defined herein. Unless context indicates otherwise, the following definitions apply throughout this specification (including the example embodiments included in the list of example embodiments attached hereto). "Shoe" and "article of footwear" are used interchangeably to refer to an article intended for wear on a human foot. A shoe may or may not enclose the entire foot of a wearer. For example, a shoe could be a sandal or other article that exposes large portions of a wearing foot.

Shoe elements can be described based on regions and/or anatomical structures of a human foot wearing that shoe, and by assuming that the interior of the shoe generally conforms to and is otherwise properly sized for the wearing foot. A forefoot region of a foot includes the phalanges, as well as the heads and bodies of the metatarsals. A forefoot element of a shoe is an element having one or more portions located under, over, to the lateral and/or medial side of, and/or in front of a wearer's forefoot (or portion thereof) when the shoe is worn. A midfoot region of a foot includes the cuboid, navicular, and cuneiforms, as well as the bases of the metatarsals. A midfoot element of a shoe is an element having one or more portions located under, over, and/or to the lateral and/or medial side of a wearer's midfoot (or portion thereof) when the shoe is worn. A heel region of a foot includes the talus and the calcaneus. A heel element of a shoe is an element having one or more portions located under, to the lateral and/or medial side of, and/or behind a wearer's heel (or portion thereof) when the shoe is worn. The forefoot region may overlap with the midfoot region, as may the midfoot and heel regions.

For purposes of describing axes and directions for a sole structure, it is assumed that surfaces of a sole structure intended for ground contact are resting on a horizontal reference plane. It is further assumed that studs or other projections from a bottom side of a sole structure do not penetrate that reference plane, and that the sole structure is not deformed. A longitudinal axis refers to a horizontal heel-toe axis that extends from a forward-most toe location on a sole structure component (e.g., "FT" in FIG. 4A) to a rearmost heel location on that sole structure component (e.g., "RH" in FIG. 4A). A longitudinal axis may be inclined with regard to the reference plane. A longitudinal direction is parallel to the longitudinal axis. A transverse axis is an axis that intersects and is perpendicular to the longitudinal axis, and that is also parallel or approximately parallel to the reference plane. A transverse direction is a direction along a transverse axis.

"Upper," when used as a noun, refers to a portion of a shoe that provides a covering for some or all of a wearer's foot and that positions that foot relative to a sole structure of that shoe. A "bottom side" of a shoe (or component thereof) refers to a side of a shoe (or component thereof) that faces towards the reference plane. A "top side" of a shoe (or component thereof) refers to a side of a shoe (or component thereof) that faces away from the reference plane.

Figure 1B:
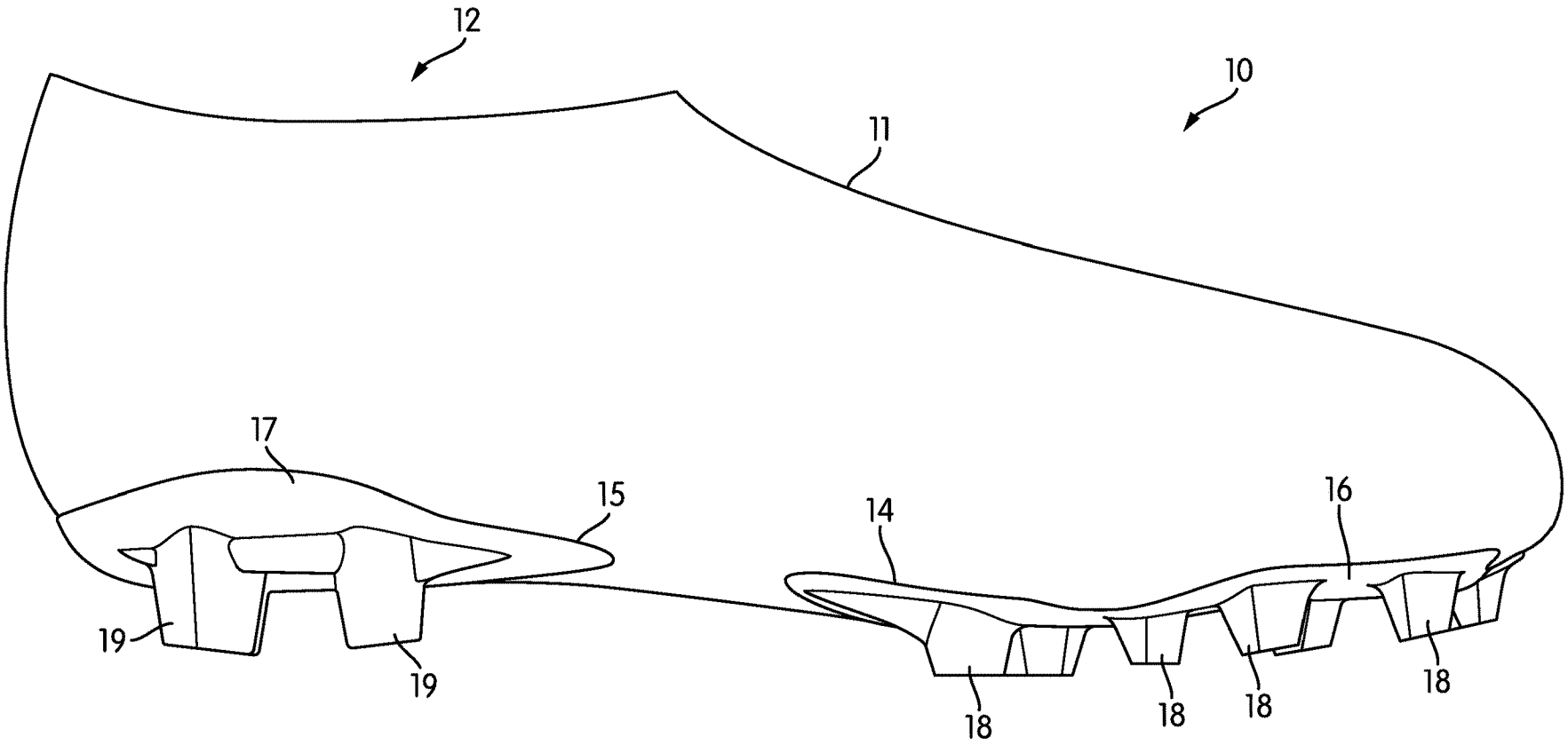
FIGS. 1B and 1C are respective lateral side and bottom views of the shoe of FIG. 1A.
Figure 1C:
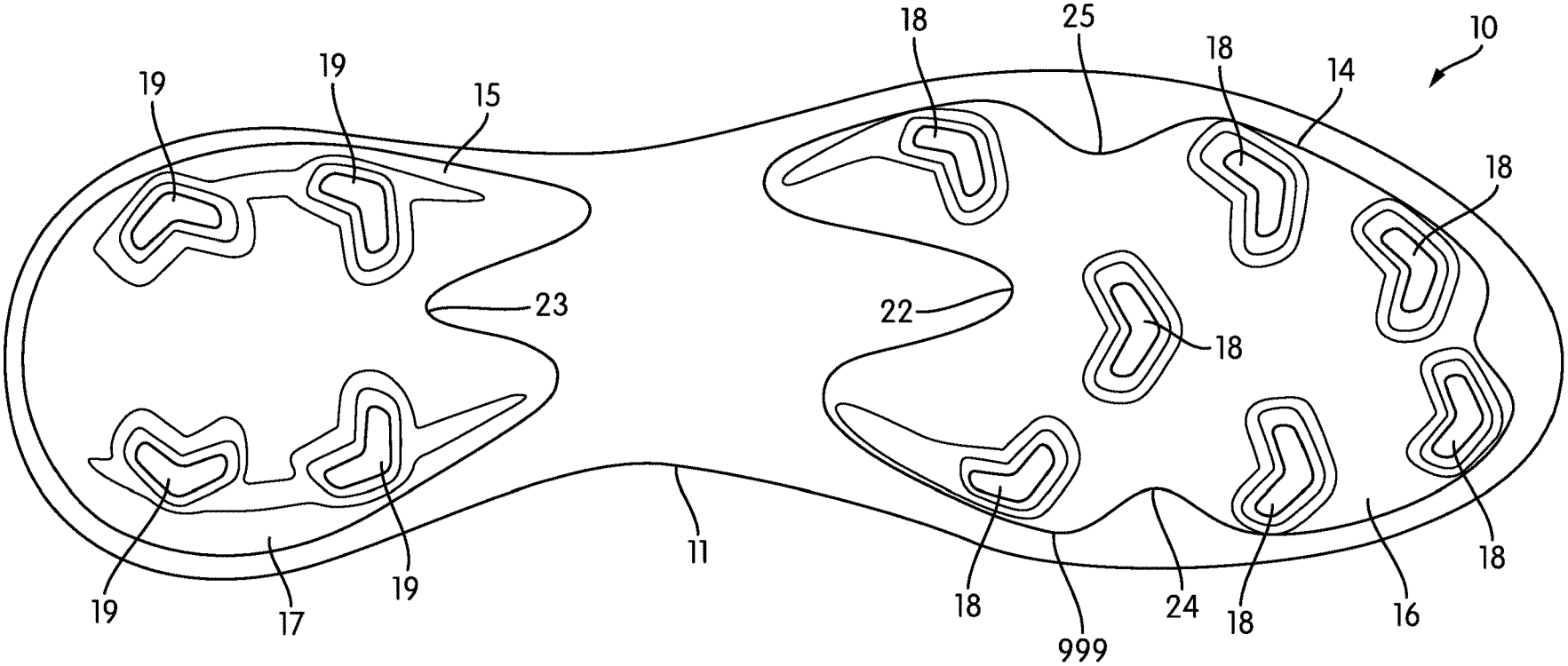

FIG. 1A is a medial side view of a shoe 10 according to some embodiments. Shoe 10 is configured for wear by a participant in the sport of football. FIG. 1B is a lateral side view of shoe 10. FIG. 1C is a bottom view of shoe 10. Shoe 10 is configured for wear on a right foot and is part of a pair that includes a shoe (not shown) that is a mirror image of shoe 10 and configured for wear on a left foot. Shoe 10 includes an upper 11 that defines a void. Upper 11 may be formed from any of various types of material and may have any of a variety of different constructions. The void defined by upper 11 includes space into which a wearer foot is received via ankle opening 12, as well as space for portions of a sole structure of shoe 10.

In particular, the sole structure of shoe 10 includes external components outside of upper 11 and interior components located within the void of upper 11. The exterior components include forward stud island 14 and rear stud island 15. Forward stud island 14 includes a stud plate 16 attached to a bottom surface of upper 11 in a forefoot region of shoe 10. A plurality of downwardly-extending studs 18 are attached to plate 16. Rear stud island 15 includes a stud plate 17 attached to a bottom surface of upper 11 in a heel region of shoe 10. A plurality of downwardly-extending studs 19 are attached to plate 17. In some embodiments, studs 18 may be integral to plate 16 and island 14 may be formed as unitary component by injection molding of thermoplastic polyurethane (TPU) and/or other polymeric materials. Similarly, studs 19 may be integral to plate 17 and island 15 may also be formed as unitary component by injection molding of TPU and/or other polymeric materials.

Stud islands 14 and 15 are configured to facilitate comfort and desired motion during play of a football match. For example, the separation between islands 14 and 15 in the midfoot region, the forwardly projecting gap 22 in the rear of island 14, and the rearwardly projecting gap 23 in the front of island 15 facilitate torsional motion about a longitudinal axis of a wearer's foot. Inwardly projecting gaps 24 and 25 on the medial and lateral sides of island 14 facilitate dorsiflexion in the forefoot region.

Figure 2:
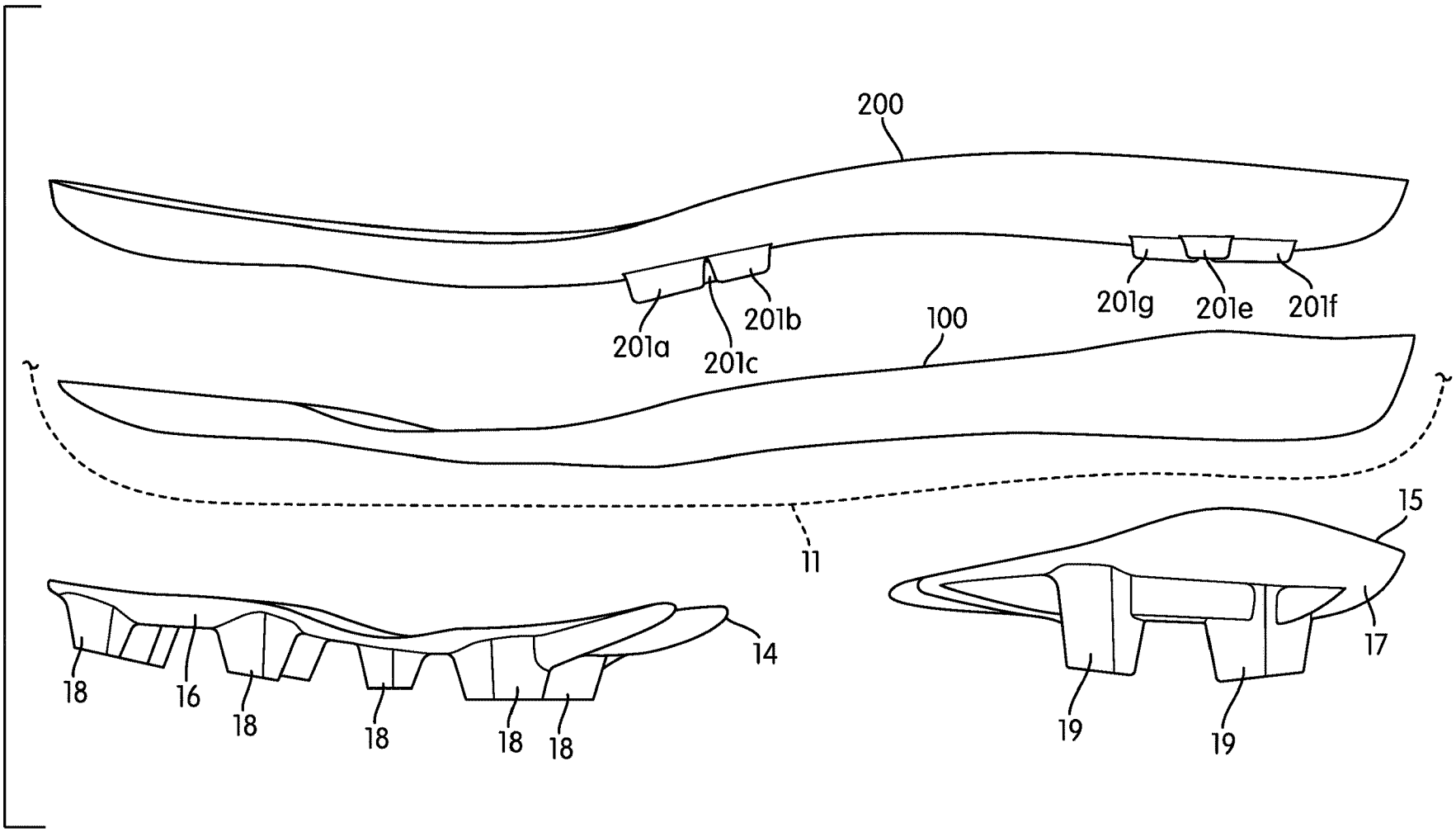
FIG. 2 is a medial side exploded view of the sole structure of the shoe of FIG. 1A.

FIG. 2 is a medial side exploded view of the sole structure of shoe 10. In addition to stud islands 14 and 15, the shoe 10 sole structure includes a chassis 100 and a sock liner 200. The location of upper 11 relative to other components is schematically indicated in FIG. 2 with a broken line representing a slightly expanded portion of the envelope of the void defined by upper 11. Chassis 100 and sock liner 200 are contained within that void. A bottom side 101 of chassis 100 is bonded to a corresponding top side of a plantar section of upper 11.

Sock liner 200 rests on top of, and partially nests within, chassis 100. The bottom side of sock liner 200 includes a plurality of downwardly-projecting tabs 201*a* through 201*h*, with only tabs 201*a*-201*c* and 201*e*-201*g* being visible in the view of FIG. 2. Those tabs will be referenced collectively and/or generically using the same reference number 201, but without an appended lower case letter. Tabs 201 index sock liner 200 to chassis 100. As explained in more detail below, each of tabs 201 rests within a cell of chassis 100 and helps to secure sock liner 200 from transverse and longitudinal movement relative to chassis 100. Surfaces of the sock liner 200 bottom side surrounding tabs 201 have contours corresponding to contours defined by peaks of walls in the frame of chassis 100, as also explained below. A top side of sock liner 200 has a surface contoured to comfortably support a socked human foot.

Figure 3A:
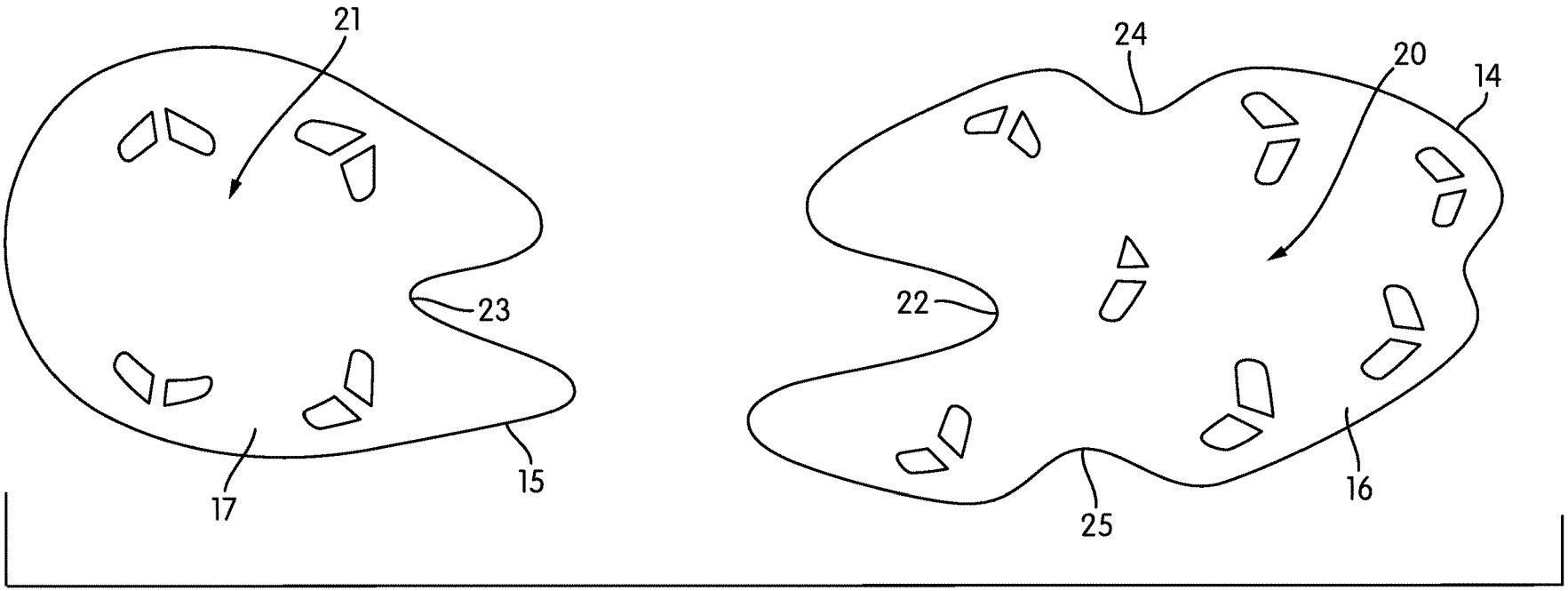
FIG. 3A is a top view of the stud islands of the sole structure of the shoe of FIG. 1A.
Figure 3B:
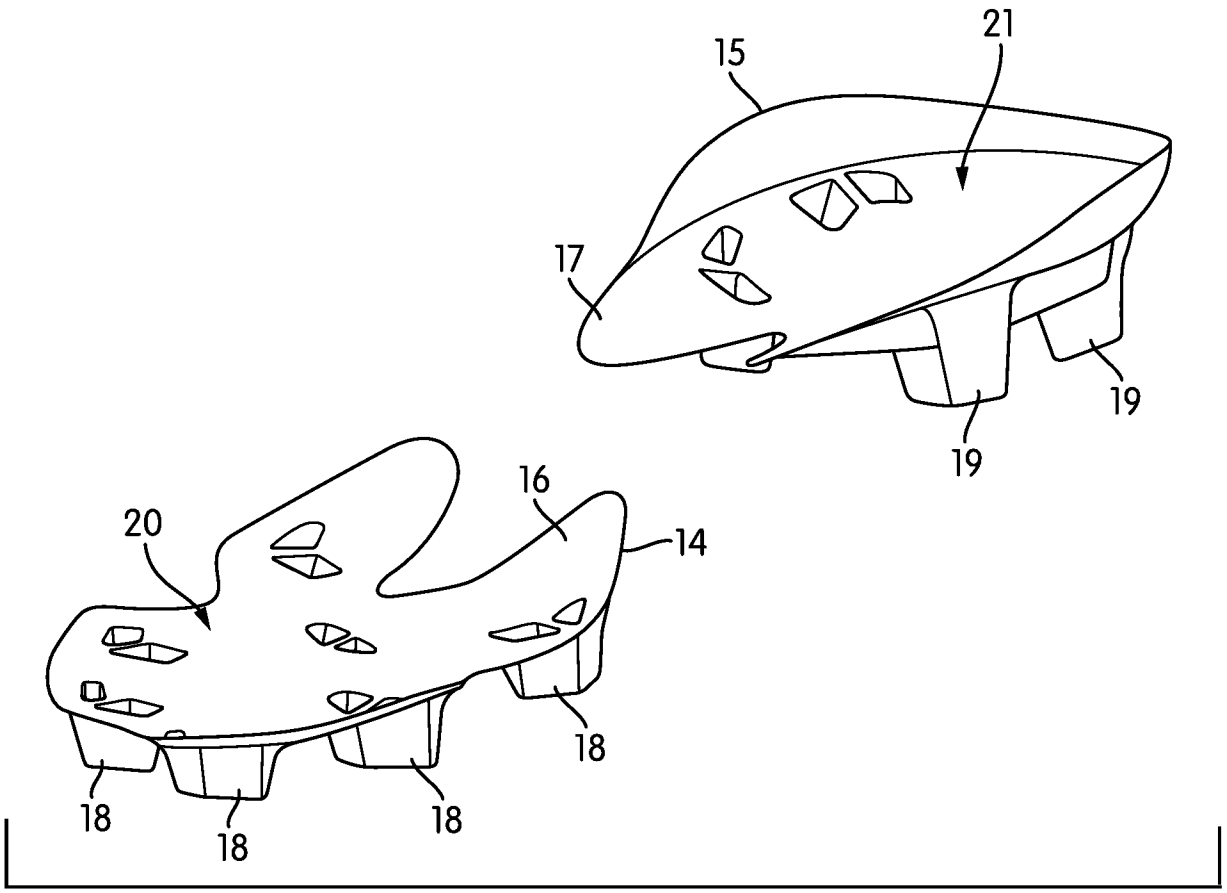
FIG. 3B is a front top medial perspective view of the stud islands of the sole structure of the shoe of FIG. 1A.

FIG. 3A is a top view of forward stud island 14 and rear stud island 15. FIG. 3B is a top front medial perspective view of stud islands 14 and 15. In FIGS. 3A and 3B, stud islands 14 and 15 are in the same relative positions as are occupied when stud islands 14 and 15 are attached to upper 11 (see FIGS. 1A-1C). Forward stud plate 16 and rear stud plate 17 respectively include top surfaces 20 and 21 that are bonded to exterior portions of a plantar section of upper 11.

Studs 18 and 19 are hollow to reduce weight, though solid studs may be used in some embodiments.

Figure 4A:
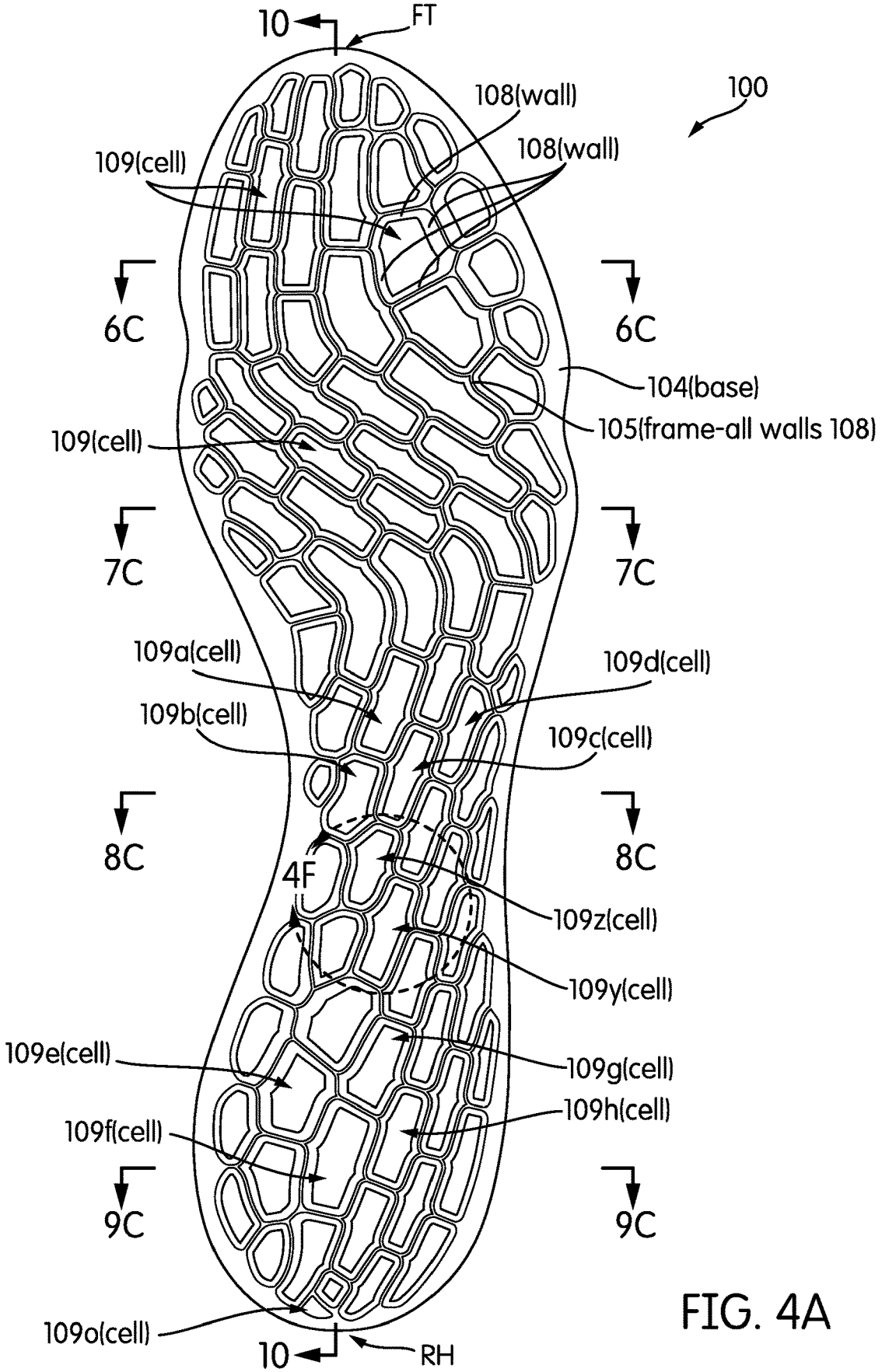
FIG. 4A is a top view of the chassis of the sole structure of the shoe of FIG. 1A.
Figure 4B:
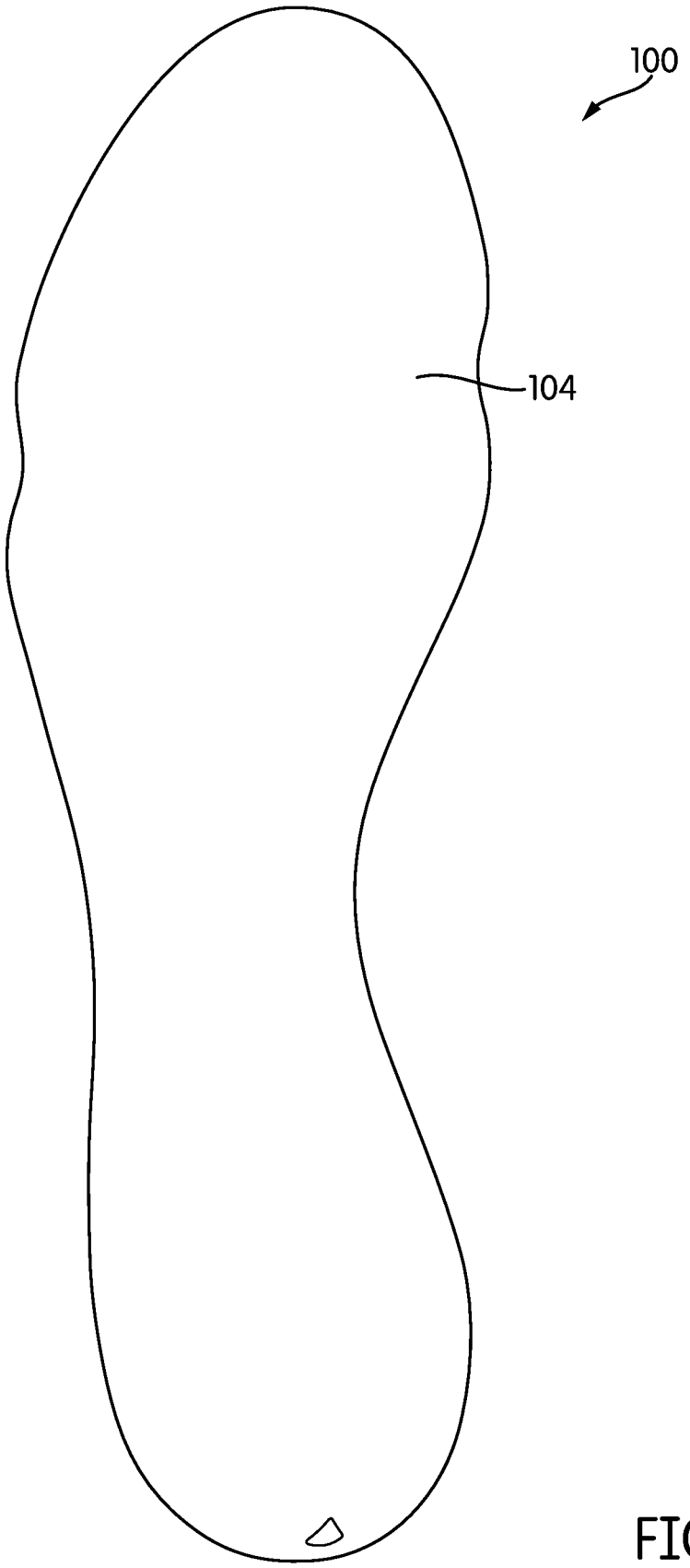
FIGS. 4B and 4C are respective bottom and top front medial perspective views of the chassis of FIG. 4A.
Figure 4C:
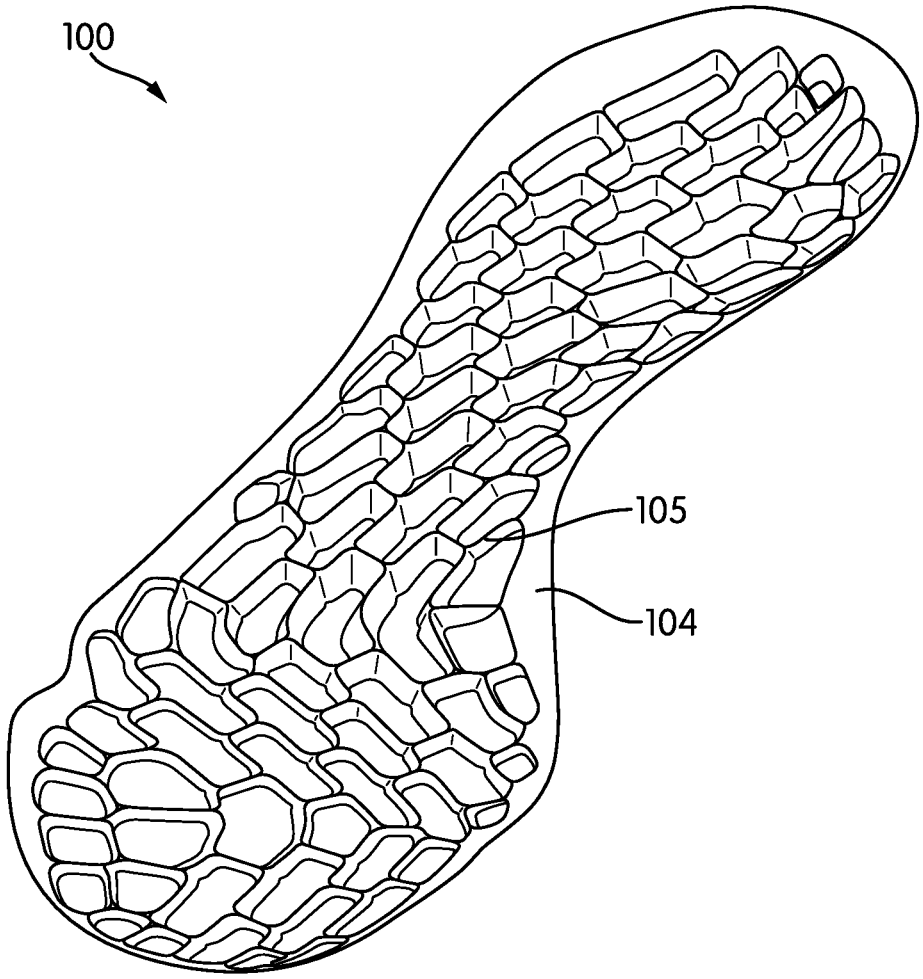
Figure 4D:
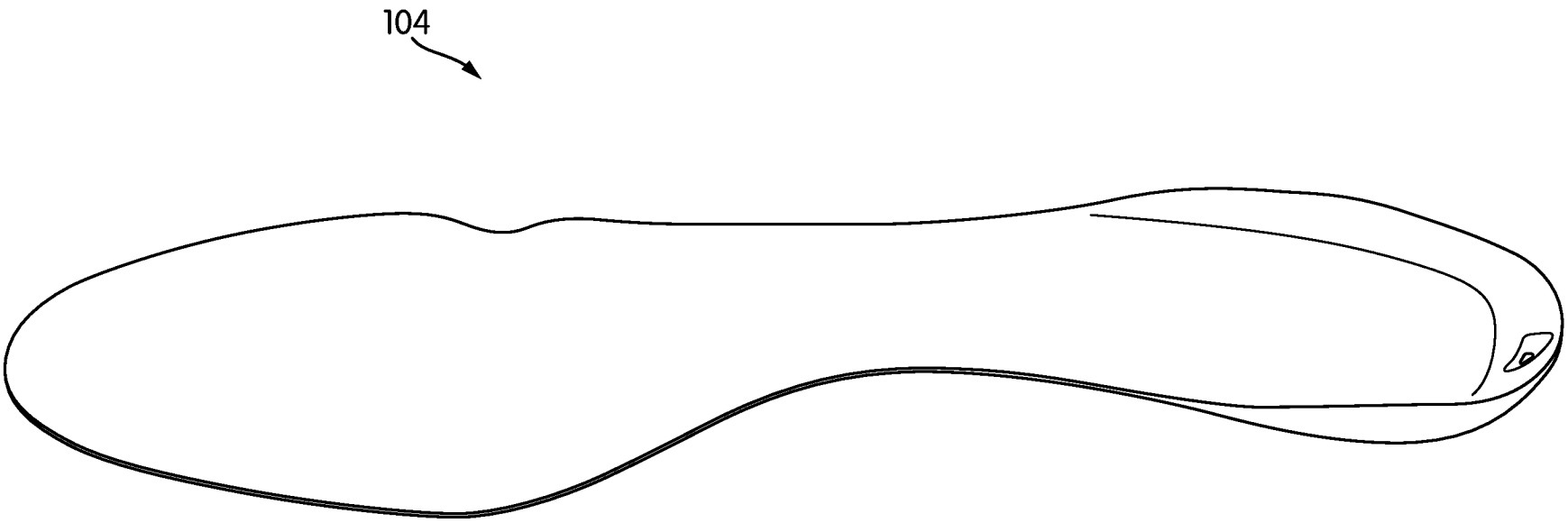
FIG. 4D is a medial side top perspective view of the base of the chassis of FIG. 4A.
Figure 4E:
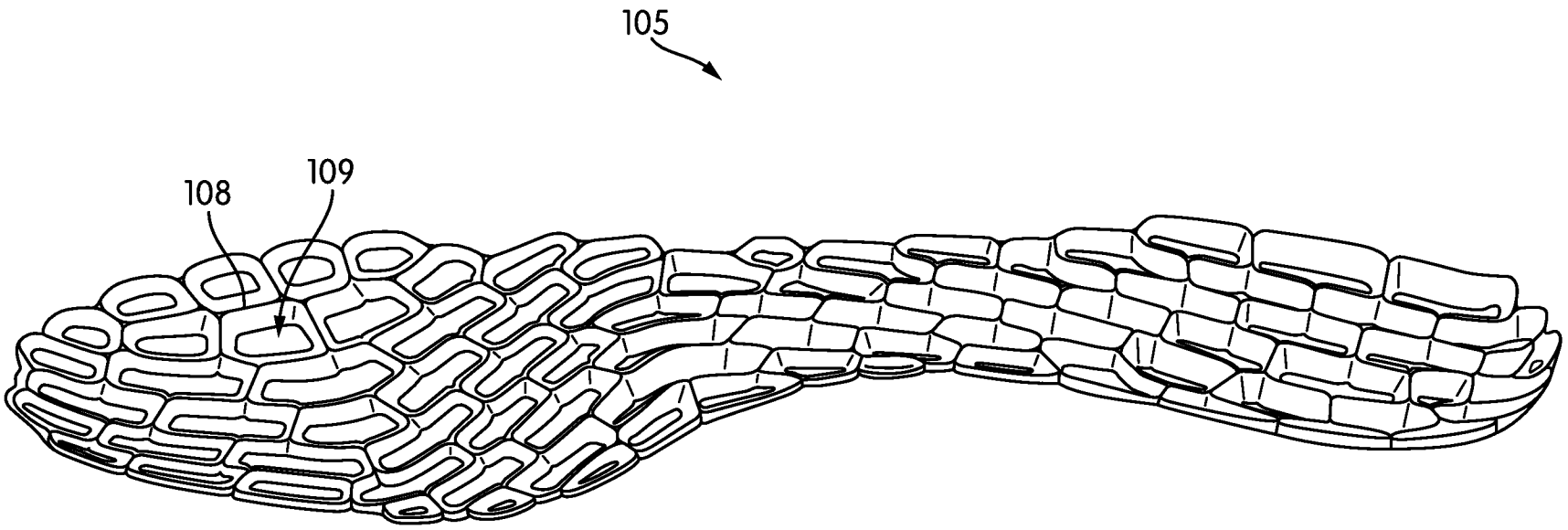
FIG. 4E is a medial side top perspective view of the frame of the chassis of FIG. 4A.

FIGS. 4A and 4B are respective top and bottom views of chassis 100. FIG. 4C is a top front medial perspective view of chassis 100. A peripheral boundary of chassis 100 has a shape that generally defines a shape of the shoe 10 sole in a plantar plane. The front-most end of chassis 100 in the toe region is indicated by "FT" in FIG. 4A. Similarly, the rearmost end of chassis 100 in the heel region is indicated by "RH." As seen in FIG. 4A, chassis 100 includes a base 104 and a frame 105. The distinction between base 104 and frame 105 is further shown in FIGS. 4D and 4E. FIG. 4D is a medial side top perspective of view of chassis 100 that omits frame 105 and only shows base 104. FIG. 4E is a medial side top perspective of view of chassis 100 that omits base 104 and only shows frame 105.

Although base 104 and frame 105 are shown as separate elements in FIGS. 4D and 4E for purposes of explanation, base 104 and frame 105 form a unitary structure. In particular, the bottom side of frame 105 is joined to the top side of base 104. In the embodiment of chassis 100, all but one of cells 109 (i.e., cell 109*o*) are closed at the bottom by base 104, and all cells 104 are open at the top. Closing a large portion of cells in a frame offers several advantages. For example, the additional material of base 104 in the cell bottoms increases the stiffness of chassis 100. Moreover, and as explained in further detail below, upper 11 is bonded to the chassis 100 bottom side. Closing of the cell bottoms increases the surface area on the chassis 100 bottom side available to create a bond. In other embodiments, however, fewer cells in a chassis may be closed at the bottom, and/or some cells may be closed at the top.

In some embodiments, chassis 100 is formed from one or more materials that are flexible, but that are incompressible. As used herein, a material is "incompressible" if, under typical loads experienced during normal wear associated with athletic activities, no volume reduction can be detected (visually or tactilely) by a normal human without the aid of a measuring device. A load is experienced during normal wear associated with an athletic activity if the load results from force of the wearer's own weight (e.g., while standing) and/or from the wearer moving from forces generated by his or her own muscular activity. Examples of incompressible materials include solid (e.g., non-foamed) polymers such as thermoplastic polyurethane, Nylon, and polyether block amide, as well as non-foamed composite materials (e.g., glass-reinforced Nylon, graphite-reinforced epoxy).

In some embodiments, chassis 100 is formed by injection molding. In some such embodiments in which base 104 is formed from a first polymeric material and frame 105 is formed from a different second polymeric material, chassis 100 may be formed using a two shot injection molding process. In some embodiments, frame 105 is formed of a material (e.g., Nylon, glass-reinforced nylon, graphite reinforced epoxy) that is less soft and/or that has a greater material stiffness than a material (e.g., polyether block amide such as that sold under the trade name PEBAX) used to form base 104. In other embodiments, a different material may be used for base 104 and/or for frame 105. In some embodiments, base 104 and frame 105 may be formed from the same material. As used herein, material stiffness is distinguished from structural stiffness and refers to inherent stiffness of a material relative to other materials. For material stiffness, a material A is stiffer than a material B if a sample of material A is more resistant to bending or other deformation than a sample of material B having the same size and cross-section as the sample of material A, and when the samples are tested in the same manner. Structural stiffness refers stiffness of a component (or combination of components) that results from both the material(s) of the component(s) and the shape of the component(s). If not otherwise indicated "stiffness" used without the modifier "material" or "structural" refers to structural stiffness.

As seen in FIGS. 4A and 4E, frame 105 includes a network of interconnected walls 108 that form a network of cells 109. To avoid obscuring FIGS. 4A and 4E with excessive reference numbers, only a few of walls 108 and cells 109 are labeled in FIGS. 4A and 4E. The labels of several of cells 109, i.e., cells 109*a*-109*h*, 109*y*, and 109*z*, further include an appended lower case letter so as to permit identification of specific cells in connection with features discussed below. When used in this description without an appended lower case letter, number 109 references cells collectively and/or generically.

Figure 4F:
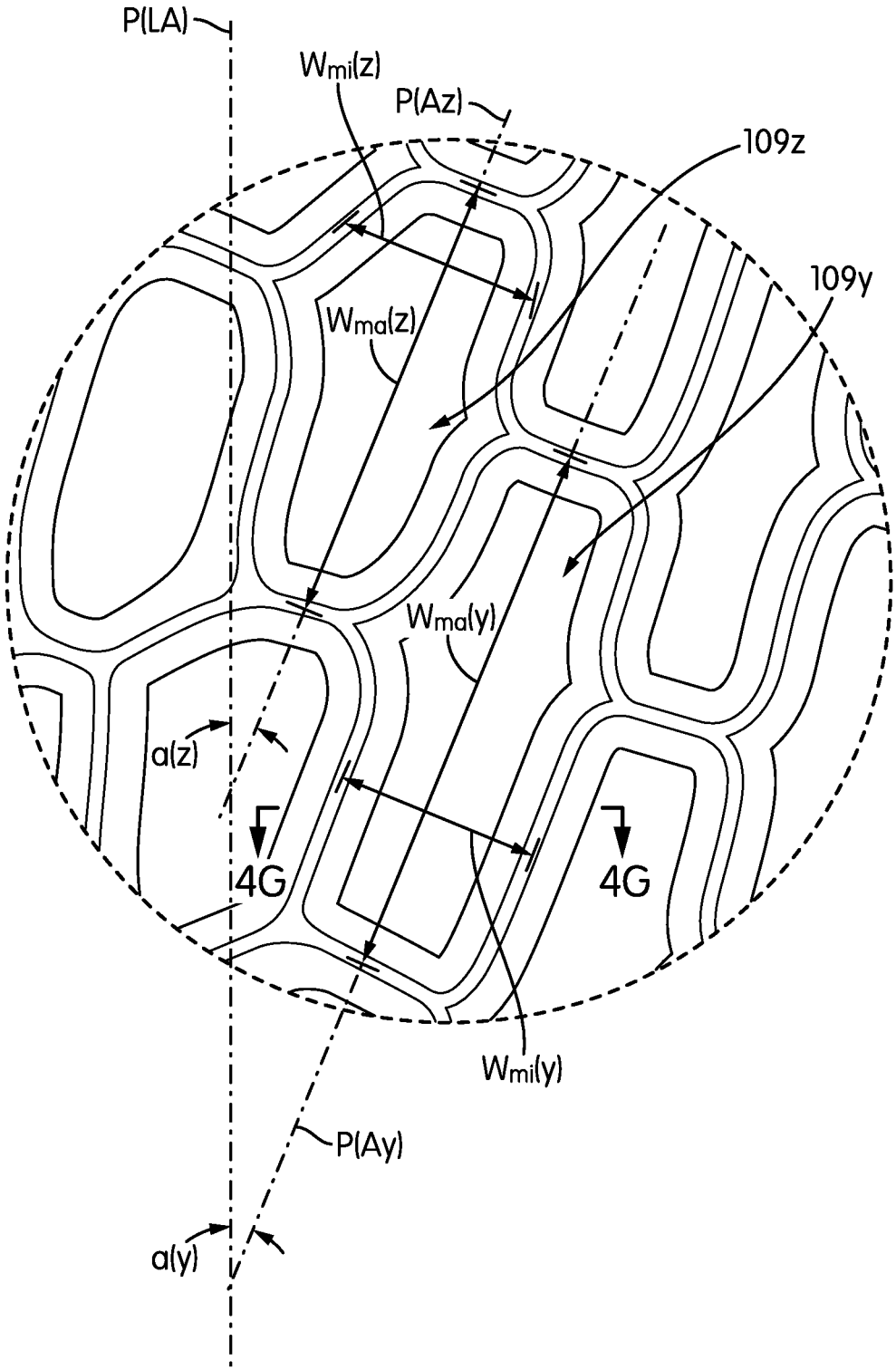
FIG. 4F is an enlarged view of the region indicated in FIG. 4A.

Several characteristics can be used to better describe features of chassis 100. These characteristics are further explained in connection with FIG. 4F, an enlarged view of the portion of chassis 100 indicated in FIG. 4A. Each of cells 109 has a major width $W_{ma}$. A major width $W_{ma}$ of a cell is the longest width that can be measured between the midpoints of any two opposing cell walls, and with the width measured between the centers of the thicknesses of the opposing walls. For example, major widths $W_{ma}(y)$ and $W_{ma}(z)$ are respectively indicated in FIG. 4F for two cells 109*y* and 109*z*. Each of cells 109 also has a minor width $W_{mi}$. A minor width $W_{mi}$ is the largest width of a cell, in a direction perpendicular to the direction of the major width for that cell, that can be measured starting at a midpoint and thickness center of one wall and ending at a thickness center of an opposing wall. At least one of the endpoints of a minor width of a cell is at the midpoint of a wall defining that cell. Minor widths $W_{mi}(y)$ and $W_{mi}(z)$ are also indicated in FIG. 4F for cells 109*y* and 109*z*, respectively. An aspect ratio for a cell may be defined as a ratio of major width to minor width ($W_{ma}/W_{mi}$).

The major axis of a cell may be an axis connecting the end points of the major width $W_{ma}$ of that cell. Each of cells 109 also has an orientation angle $\alpha$ formed between an orthogonal projection in the horizontal reference plane of the cell major axis and an orthogonal projection in the horizontal reference plane of the chassis 100 longitudinal axis LA. Cell orientation angle may be measured in a forward quadrant of the intersection between the projections of the cell major axis and longitudinal axis LA. As indicated in FIG. 4F, cell 109*y* has an orientation angle $\alpha(y)$ between P(LA), an orthogonal projection in the horizontal reference plane of longitudinal axis LA, and P(Ay), an orthogonal projection in that same horizontal reference plane of cell 109*y* major axis Ay. Similarly, cell 109*z* has an orientation angle $\alpha(z)$ between P(LA) and P(Az), an orthogonal projection in that same horizontal reference plane of cell 109*z* major axis Az.

The major axes of cells 109*y* and 109*z* point forwardly and laterally. In particular, orientation angles $\alpha(y)$ and $\alpha(z)$, in forward lateral quadrants of intersections between horizontal plane orthogonal projections of the cell major axes and a horizontal plane orthogonal projection of longitudinal axis LA, are significantly less than 90°. An orientation angle may be considered "significantly less than 90°" if that angle is between 0° and 80°. In the embodiment of chassis 100, orientation angles $\alpha(y)$ and $\alpha(y)$ are roughly equal and are approximately 22°.

Figure 4G:
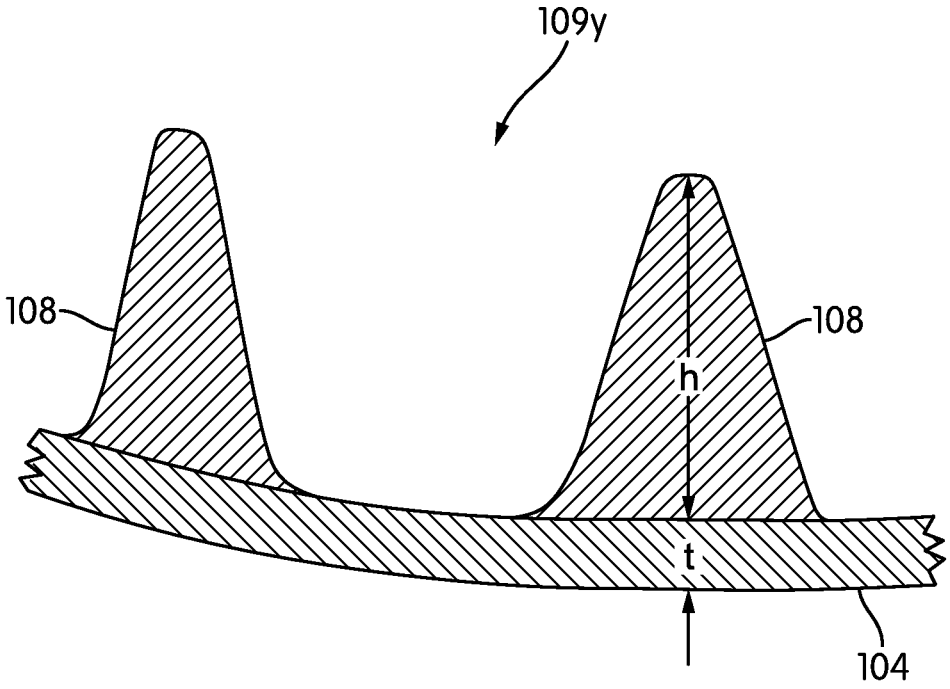
FIG. 4G is a further enlarged, partially schematic, area cross-sectional view, taken from the location indicated in FIG. 4F, and rotated by 180°.

FIG. 4G is a partially schematic area cross-sectional view taken from the location indicated in FIG. 4F and rotated by 180°. FIG. 4G is also further enlarged relative to FIG. 4F. As shown in FIG. 4G, each wall 108 has a height h in any cross-sectional plane passing through the wall. Moreover, base 104 has a corresponding thickness t under that height h.

Figure 4H:
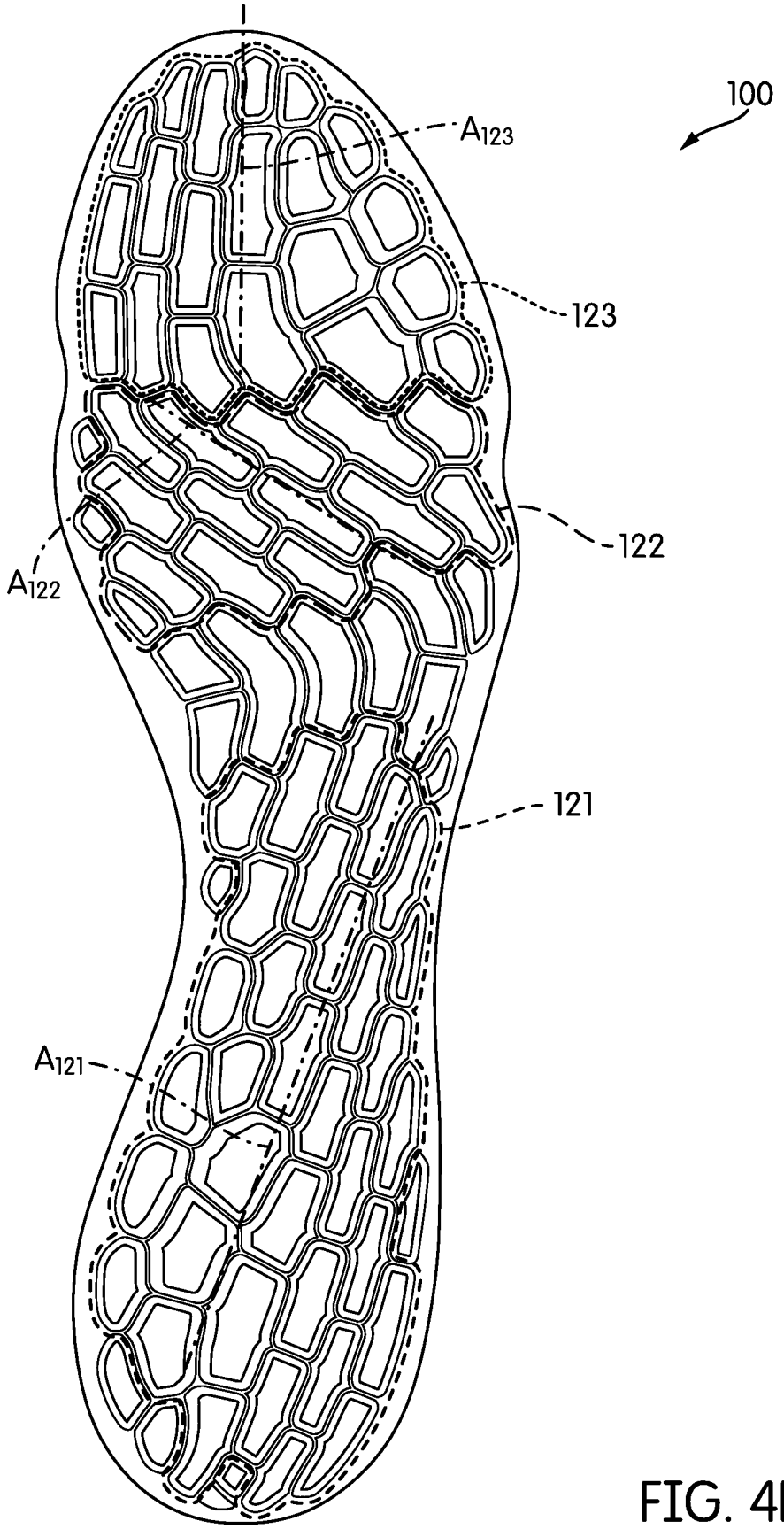
FIG. 4H is another top view of the chassis of the sole structure of the shoe of FIG. 1A.

FIG. 4H is a top view of chassis 100 similar to that of FIG. 4A, but with several sets of cells 109 indicated. A first set 121 includes cells 109 distributed in heel and rear midfoot regions of chassis 100. The cells 109 in set 121 include cells 109*y* and 109*z* discussed above, as well as cells 109*a*-109*h* discussed below. Each of the cells 109 in set 121 has a major axis that points forwardly and laterally. In some embodiments, each of the cells 109 in set 121 has an orientation angle, in a forward lateral quadrant of an intersection between a horizontal reference plane orthogonal projection of the cell major axis and a horizontal reference plane orthogonal projection of longitudinal axis LA, of between 5° and 40°. In some such embodiments, that range is between 15° and 30°.

A second set 122 includes cells 109 distributed in a forefoot region of chassis 100. Each of the cells 109 in set 122 has a major axis that points forwardly and medially. In some embodiments, each of the cells 109 in set 122 has an orientation angle, in a forward medial quadrant of an intersection between a horizontal reference plane orthogonal projection of the cell major axis and a horizontal reference plane orthogonal projection of longitudinal axis LA, of between 40° and 75°. In some such embodiments, that range is between 50° and 65°. In the embodiment of FIG. 4H, multiple cells 109 in set 122 have orientation angles (in the forward medial quadrant) of approximately 57°.

A third set 123 includes cells 109 distributed in a phalangeal region of chassis 100. Each of the cells 109 in set 123 has a major axis that points forwardly, forwardly and slightly laterally, or forwardly and slightly medially. In some embodiments, each of the cells 109 in set 123 has an orientation angle, in either a forward medial or forward lateral quadrant of an intersection between a horizontal reference plane orthogonal projection of the cell major axis and a horizontal reference plane orthogonal projection of longitudinal axis LA, of between 0° and 20°. In some such embodiments, that range is between 0° and 15°.

The cell shapes and orientations shown in FIG. 4H, in combination with heights of walls 108 of those cells, offer advantages for a football shoe. Cells 109 in set 121 facilitate some twisting of a wearer foot in the heel and rear midfoot region about an axis generally aligned with the major axes of the cells 109 in set 121. That axis is indicated in FIG. 4H as $A_{121}$. However, those cells provide increased resistance to bending in the heel and rear midfoot region about horizontal axes perpendicular to axis $A_{121}$. Cells 109 in set 122 provide minimal resistance to bending/twisting of a wearer foot in a rear forefoot region about an axis generally aligned with the major axes of the cells 109 in set 122. That axis is indicated in FIG. 4H as $A_{122}$. However, those cells provide somewhat greater resistance to bending and twisting in the rear forefoot region about horizontal axes perpendicular to axis $A_{122}$. Cells 109 in set 123 provide minimal resistance to bending/twisting of a wearer foot in a phalangeal region about an axis generally aligned with the major axes of the cells 109 in set 123. That axis is indicated in FIG. 4H as $A_{123}$. However, those cells provide somewhat greater resistance to bending and twisting in the phalangeal region about horizontal axes perpendicular to axis $A_{122}$. Axes $A_{121}$, $A_{122}$, and $A_{123}$ generally correspond to axes of foot motions during football.

Figure 5A:
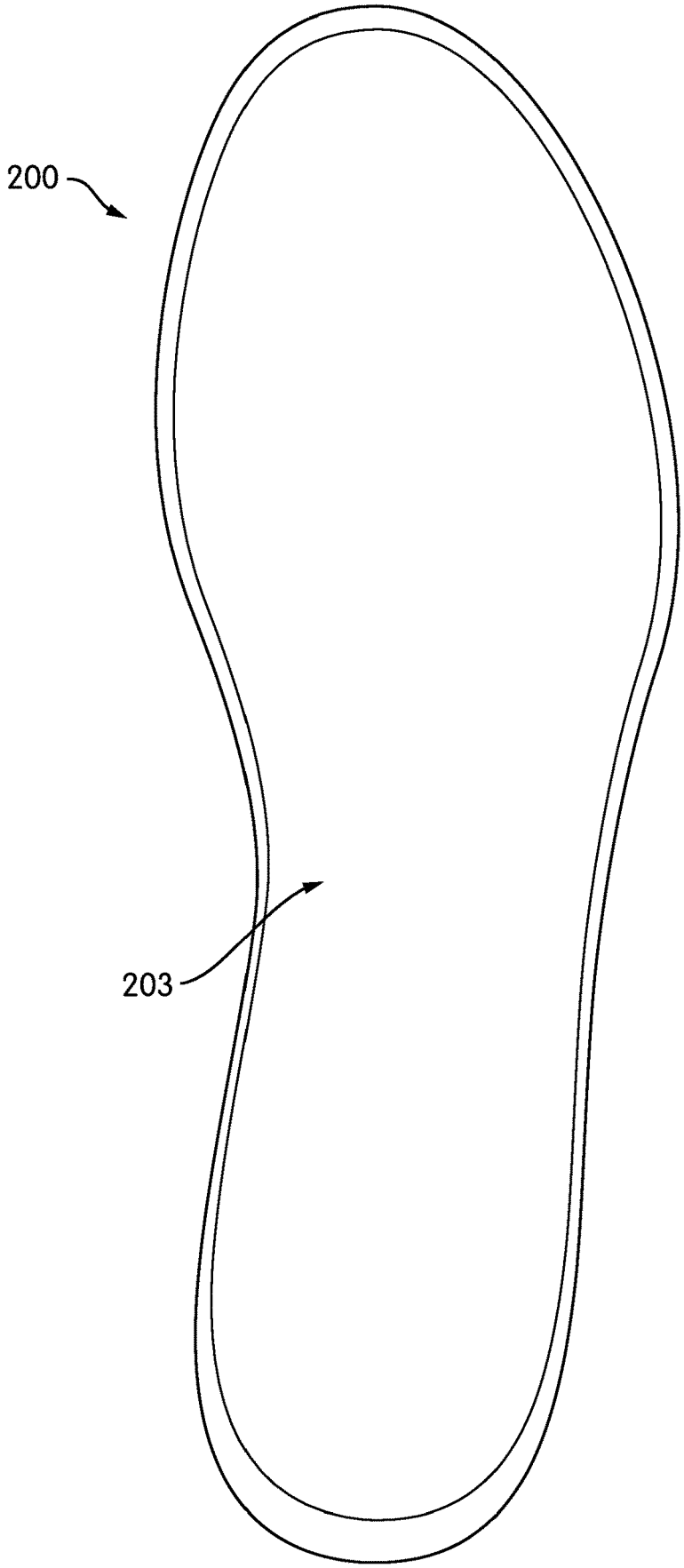
FIG. 5A is a top view of the sock liner of the sole structure of the shoe of FIG. 1A.

FIG. 5A is a top view of sock liner 200. The top side of sock liner 200 includes a surface 203 that is contoured to comfortably conform to and support the plantar region of a socked human foot wearing shoe 10. A peripheral boundary of sock liner 200 has a shape corresponding to a shape of a shoe sole in a plantar plane.

Figure 5B:
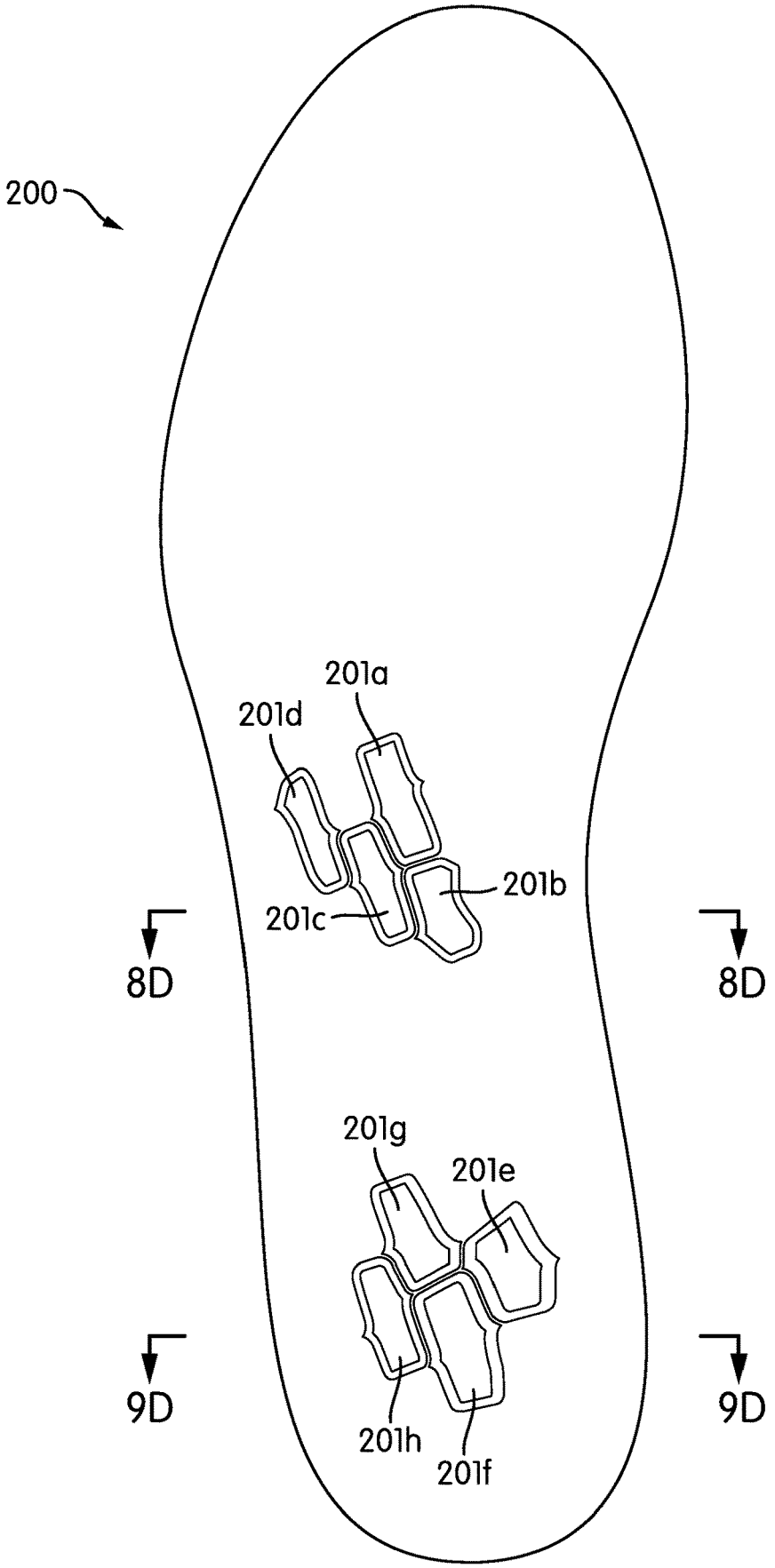
FIGS. 5B and 5C are respective bottom and top front medial perspective views of the sock liner of FIG. 5A.

FIG. 5B is a bottom view of sock liner 200. The bottom side of sock liner 200 includes downwardly projecting tabs 201*a*-201*h*. Tabs 201*a*-201*h* correspond to cells 109*a*-109*h* (see FIG. 4A). Each of tabs 201*a*-201*h* has a shape that matches the internal volume of the upper portion of the corresponding cell. When shoe 10 is assembled, each of tabs 201*a*-201*h* nests within its corresponding cell. In this manner, transverse and longitudinal shifting of sock liner 200 relative to chassis 100 is restricted.

Tabs 201*a*-201*d* are located in a midfoot region of sock liner 200 and tabs 201*e*-201*h* are located in a heel region of sock liner 200. In other embodiments, sock liner 200 may also or alternatively include heel, midfoot, and/or forefoot region tabs corresponding to other cells of chassis 100.

The remainder of the sock liner 200 bottom side surrounding tabs 201*a*-201*h* has a contour that generally correspond to a contour defined by the top edges of walls 108 of frame 105. As seen in FIGS. 6A, 7A, 8A, and 9A, this allows sock liner 200 to partially nest within, and be supported by, chassis 100.

Figure 5C:
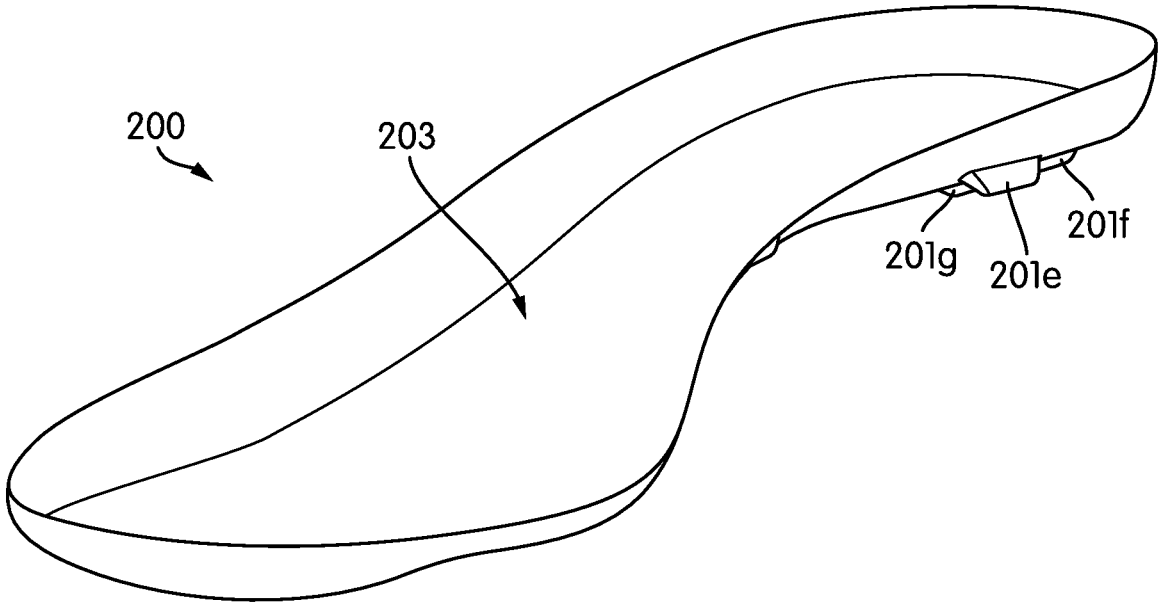

FIG. 5C is a top front medial perspective view of sock liner 200 showing additional details of the contour of surface 203.

Figure 6A:
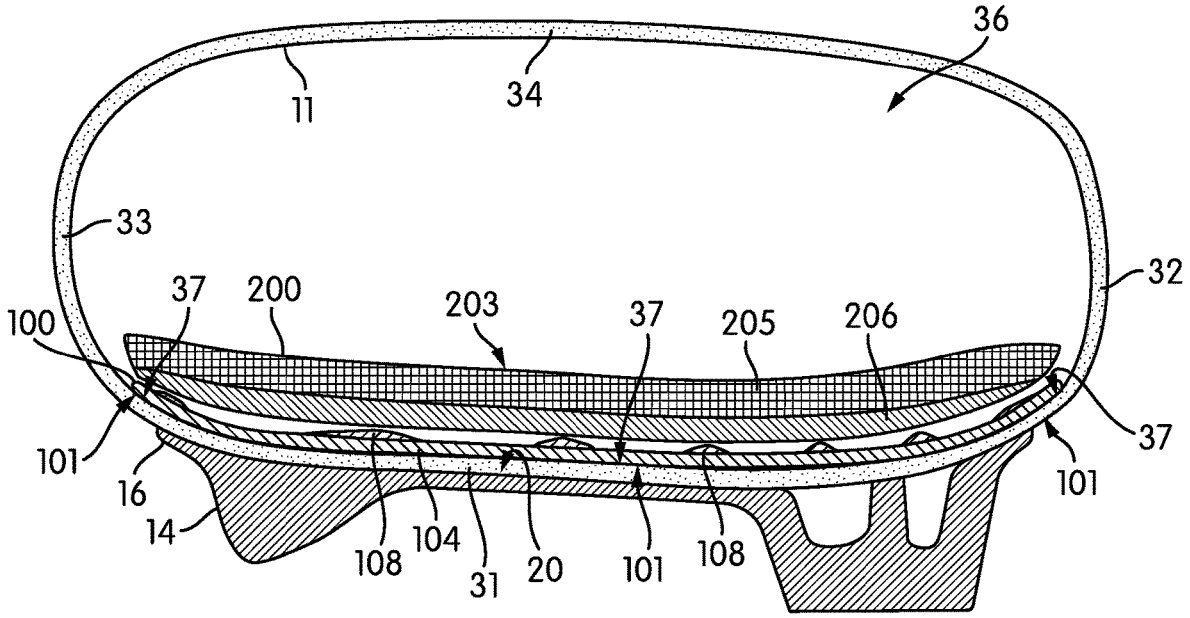
FIG. 6A is a partially schematic area cross-sectional view taken from the location indicated in FIG. 1A as sectioning plane 6-6.

FIG. 6A is a partially schematic area cross-sectional view of shoe 10 taken from the location indicated in FIG. 1A as sectioning plane 6-6. Visible in FIG. 6A are portions of upper 11, sock liner 200, chassis 100, and forward stud island 14. As seen in FIG. 6A, upper 11 includes a plantar section 31, a medial side section 32, a lateral side section 33, and a dorsal section 34. Sections 31-34 surround and define a void 36. Chassis 100 and sock liner 200 are positioned in the bottom of void 36 and extend through heel, midfoot and forefoot regions of the void. The remainder of void 36 above top surface 203 of sock liner 200 is sized and shaped to receive and conform to a foot of a shoe 10 wearer.

Bottom side 101 of chassis 100 is bonded to the top surface 37 of plantar section 31. As used herein, "bonding" includes joining through use of glue or other adhesive agents, as well as fusing by thermally melting (or chemically dissolving) one or more elements and allowing those elements to solidify as part of an interconnected configuration. The bottom side of sock liner 200 rests against peaks of walls 108 of chassis 100. Top surface 20 of stud island 14 forward plate 16 is bonded to an exterior surface of plantar section 31.

As also shown in FIG. 6A, sock liner 200 may include multiple layers, with each layer comprising a different material. In the embodiment of shoe 100, sock liner 200 includes a top layer 205 and a bottom layer 206. Top layer 205 may be less dense and/or more compressible than bottom layer 206 and/or may be configured to facilitate air movement and/or moisture wicking. Bottom layer 206 may be denser and/or less compressible than top layer 205 so as to provide support for and define the shape of top surface 203, and so as to provide additional structural reinforcement for tabs 201*a*-201*h*. Examples of materials that can be used for top layer 205 include, without limitation, foamed ethylene vinyl acetate (EVA), foamed polyurethane (PU), or blown rubber. Examples of materials that can be used for bottom layer 206 include, without limitation, foamed EVA, foamed PU, or blown rubber. Layers 205 and 206 may be bonded across their entire interface. In some embodiments, sock liner 200 may be formed by injection molding.

In some embodiments, the bottom side of sock liner 200 may be treated so as to create tackiness to help secure sock liner 200 in position, but to also allow non-destructive removal of sock liner 200 from shoe 10.

Figure 6B:
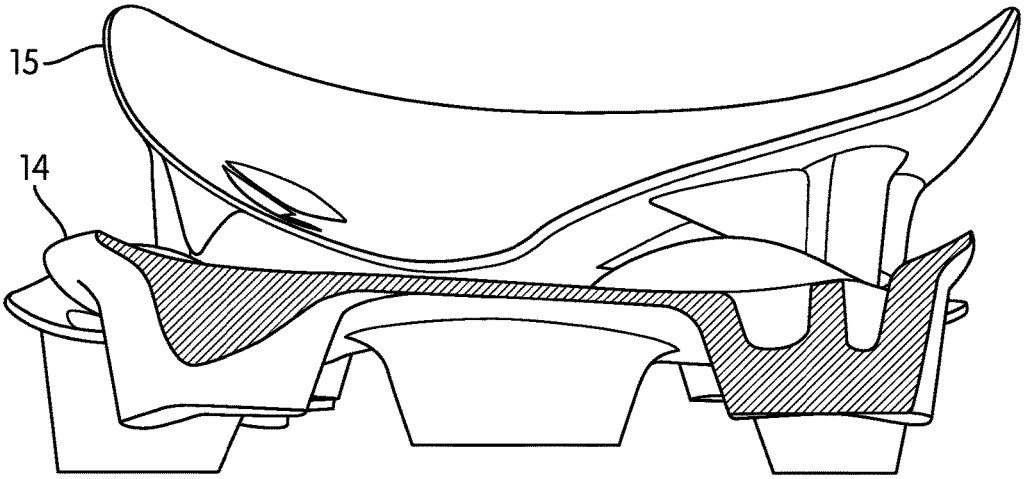
FIG. 6B is a partially schematic cross-sectional view, taken from the location indicated in FIG. 1A as sectioning plane 6-6, of the stud islands of the sole structure of the shoe FIG. 1A.
Figure 6C:
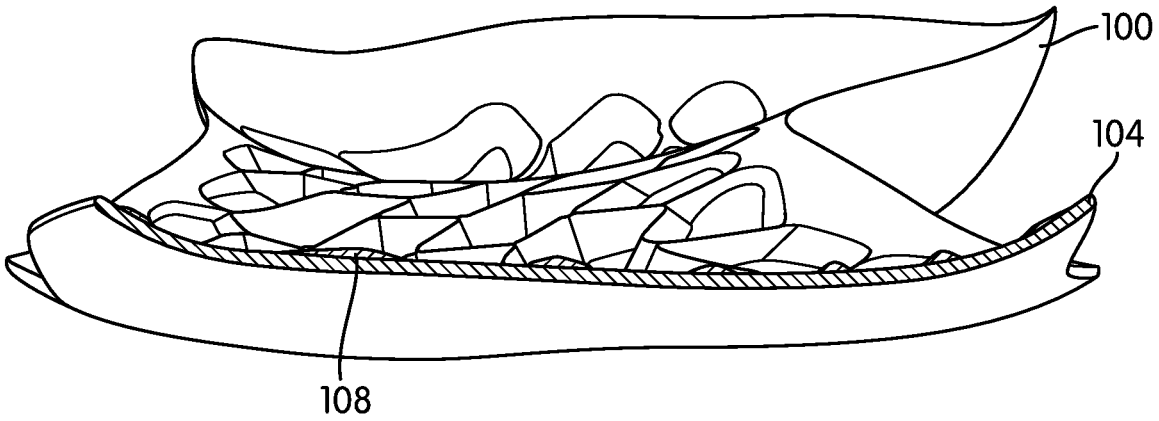
FIG. 6C is a partially schematic cross-sectional view, taken from the location indicated in FIG. 1A as sectioning plane 6-6, as well as from the location indicated in FIG. 4A as sectioning plane 6C-6C and rotated by 180°, of the chassis of the sole structure of the shoe of FIG. 1A.
Figure 6D:
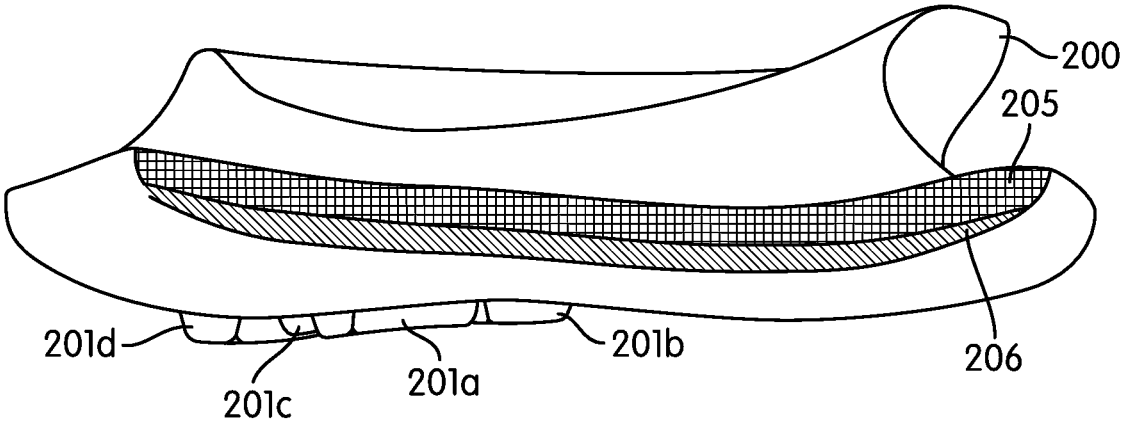
FIG. 6D is a partially schematic cross-sectional view, taken from the location indicated in FIG. 1A as sectioning plane 6-6, of the sock liner the sole structure of the shoe of FIG. 1A.

Additional details of the shoe 10 sole structure, relative to the cross-sectional plane on which FIG. 6A is based, can be seen in FIGS. 6B-6D. FIG. 6B is a partially schematic cross-sectional view, taken from sectioning plane 6-6 (FIG. 1A), showing only stud islands 14 and 15. FIG. 6C is a partially schematic cross-sectional view, taken from sectioning plane 6-6, showing only chassis 100. FIG. 6C is also a partially schematic cross-sectional view taken from the location indicated in FIG. 4A as sectioning plane 6C-6C and rotated by 180°. FIG. 6D is a partially schematic cross-sectional view, taken from sectioning plane 6-6, showing only sock liner 200.

Figure 6E:
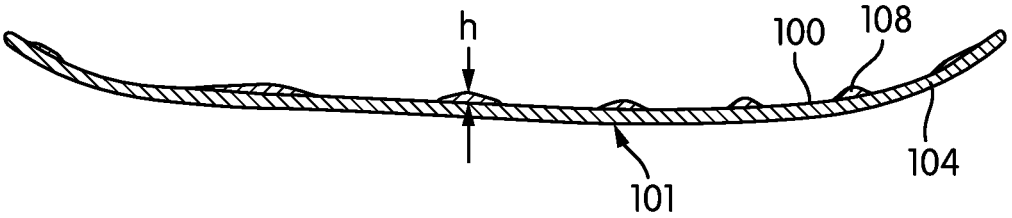
FIG. 6E is a partially schematic area cross-sectional view, taken from the location indicated in FIG. 1A as sectioning plane 6-6, as well as from the location indicated in FIG. 4A as sectioning plane 6C-6C and rotated by 180°, of the chassis of the sole structure of the shoe of FIG. 1A.

FIG. 6E is a partially schematic area cross-sectional view taken from sectioning plane 6-6 (FIG. 1A) and limited to chassis 100. FIG. 6E is also a partially schematic area cross-sectional view taken from sectioning plane 6C-6C (FIG. 4A) and rotated by 180°. As seen in FIG. 6E, walls 108 have relatively short heights h in the forefoot region. In some embodiments, frame walls 108 in a forefoot region corresponding to FIG. 6E have heights that less than or equal to the corresponding thicknesses of base 104.

Figure 7A:
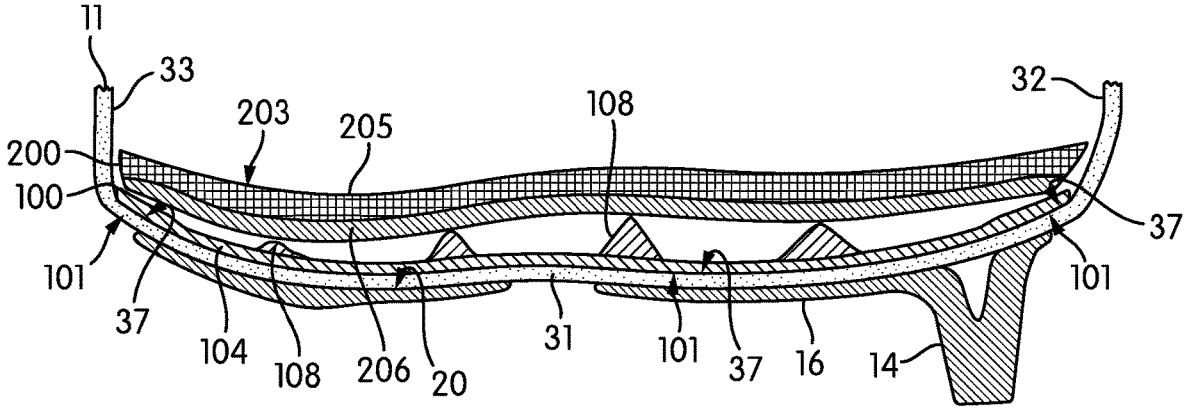
FIG. 7A is a partially schematic area cross-sectional view taken from the location indicated in FIG. 1A as sectioning plane 7-7.

FIG. 7A is a partially schematic area cross-sectional view of shoe 10 taken from the location indicated in FIG. 1A as sectioning plane 7-7. In FIG. 7A, portions of upper 11 have been omitted for convenience. As in FIG. 6A, chassis 100 and sock liner 200 are positioned in the bottom of void 36, with bottom side 101 of chassis 100 bonded to the top surface 37 of plantar section 31, and with the bottom side of sock liner 200 resting against peaks of walls 108 of chassis 100. Top surface 20 of stud island 14 forward plate 16 is bonded to an exterior surface of plantar section 31.

Figure 7B:
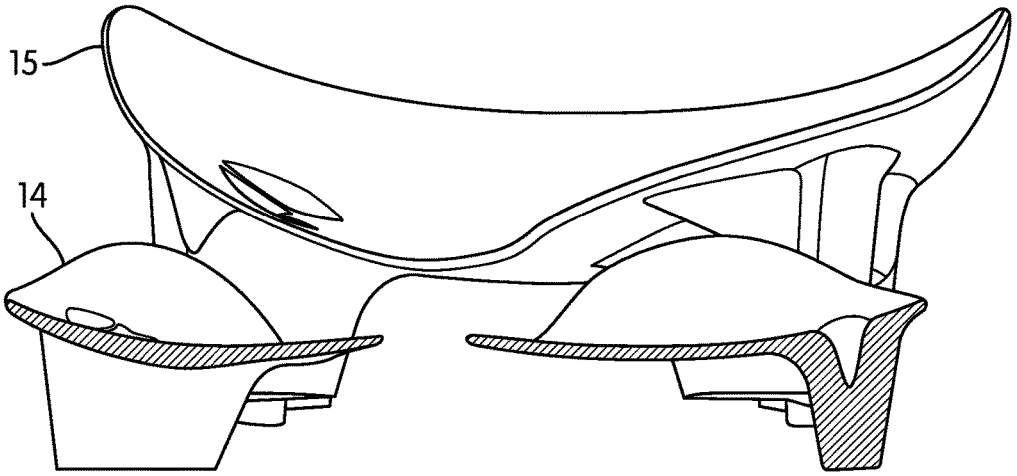
FIG. 7B is a partially schematic cross-sectional view, taken from the location indicated in FIG. 1A as sectioning plane 7-7, of the stud islands of the sole structure of the shoe FIG. 1A.
Figure 7C:
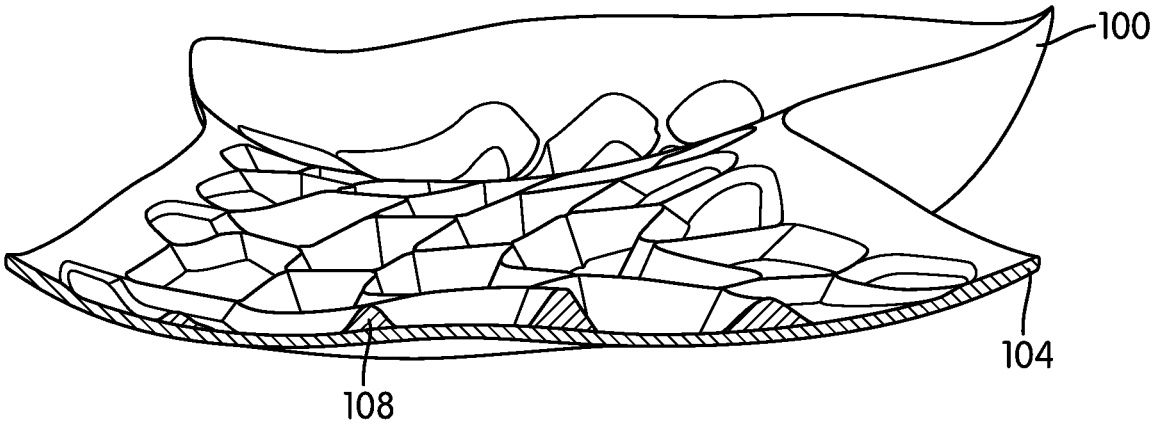
FIG. 7C is a partially schematic cross-sectional view, taken from the location indicated in FIG. 1A as sectioning plane 7-7, as well as from the location indicated in FIG. 4A as sectioning plane 7C-7C and rotated by 180°, of the chassis of the sole structure of the shoe of FIG. 1A.
Figure 7D:
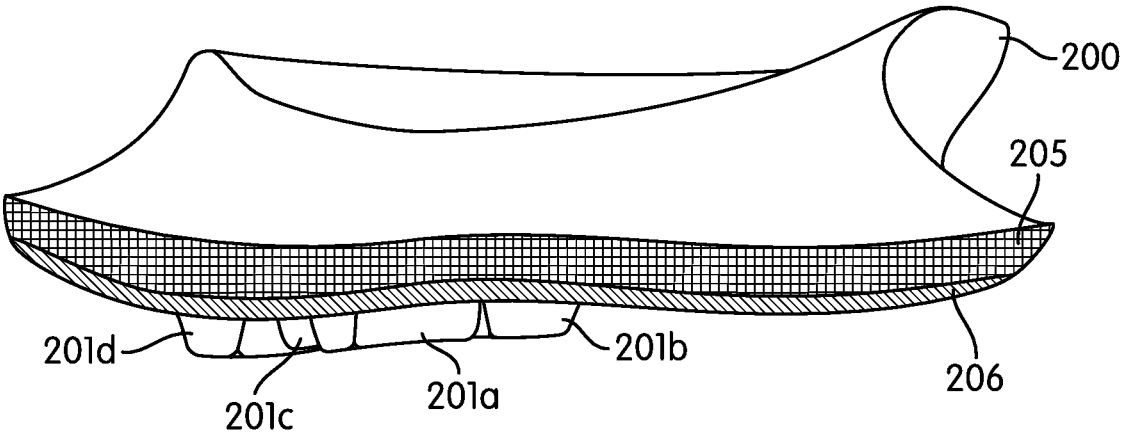
FIG. 7D is a partially schematic cross-sectional view, taken from the location indicated in FIG. 1A as sectioning plane 7-7, of the sock liner the sole structure of the shoe of FIG. 1A.

Additional details of the shoe 10 sole structure, relative to the cross-sectional plane on which FIG. 7A is based, can be seen in FIGS. 7B-7D. FIG. 7B is a partially schematic cross-sectional view, taken from sectioning plane 7-7 (FIG. 1A), showing only stud islands 14 and 15. FIG. 7C is a partially schematic cross-sectional view, taken from sectioning plane 7-7, showing only chassis 100. FIG. 7C is also a partially schematic cross-sectional view taken from the location indicated in FIG. 4A as sectioning plane 7C-7C and rotated by 180°. FIG. 7D is a partially schematic cross-sectional view, taken from sectioning plane 7-7, showing only sock liner 200.

Figure 7E:
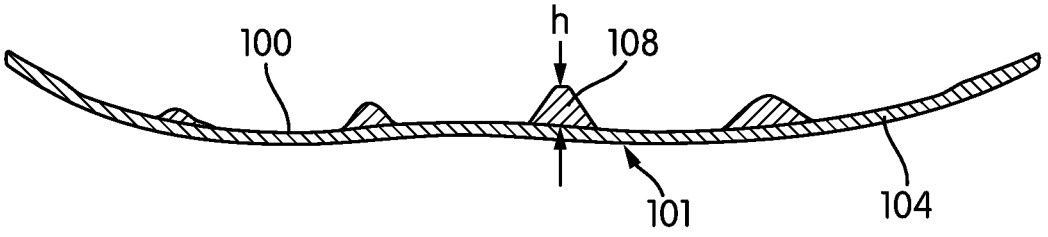
FIG. 7E is a partially schematic area cross-sectional view, taken from the location indicated in FIG. 1A as sectioning plane 7-7, as well as from the location indicated in FIG. 4A as sectioning plane 7C-7C and rotated by 180°, of the chassis of the sole structure of the shoe of FIG. 1A.

FIG. 7E is a partially schematic area cross-sectional view taken from sectioning plane 7-7 (FIG. 1A) and limited to chassis 100. FIG. 7E is also a partially schematic area cross-sectional view taken from sectioning plane 7C-7C (FIG. 4A) and rotated by 180°. As seen in FIG. 7E, walls 108 have larger heights h in the rear forefoot and forward midfoot regions. In some embodiments, at least some frame walls 108 in a forward forefoot region corresponding to FIG. 7E have heights that are at least twice the corresponding thicknesses of base 104.

Figure 8A:
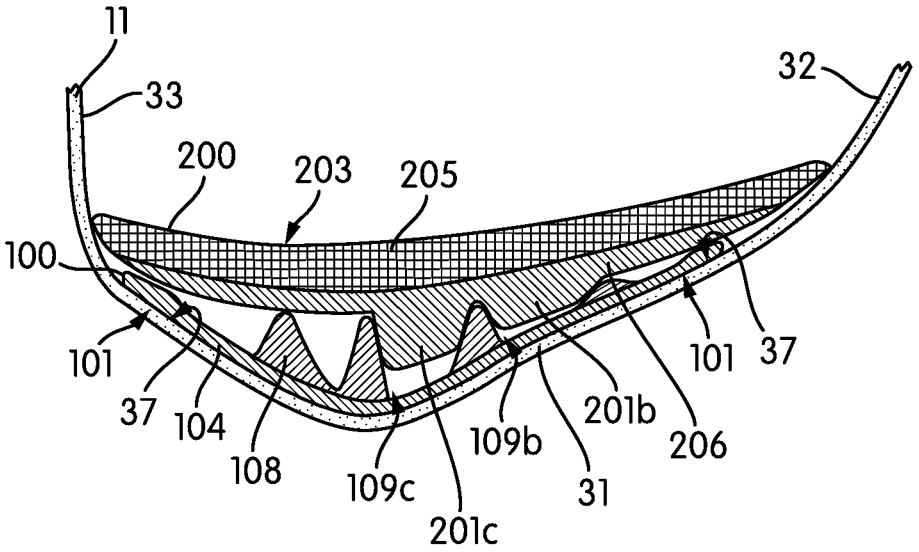
FIG. 8A is a partially schematic area cross-sectional view taken from the location indicated in FIG. 1A as sectioning plane 8-8.

FIG. 8A is a partially schematic area cross-sectional view of shoe 10 taken from the location indicated in FIG. 1A as sectioning plane 8-8. In FIG. 8A, portions of upper 11 have again been omitted for convenience. As in FIGS. 6A and 7A, chassis 100 and sock liner 200 are positioned in the bottom of void 36, with bottom side 101 of chassis 100 bonded to the top surface 37 of plantar section 31, and with the bottom side of sock liner 200 resting against peaks of walls 108 of chassis 100.

FIG. 8A also illustrates the cooperation of tabs 201*b* and 201*c* with corresponding cells 109 to restrain sock liner 200 from shifting relative to chassis 100. Tab 201*b* has a shape that corresponds to, and that nests snugly within, the top portion of cell 109*b*. Similarly, tab 201*c* has a shape that corresponds to, and that nests snugly within, the top portion of cell 109*c*. Tabs 201*a* and 201*d* similarly have shapes that correspond to, and that nest snugly within, the tops of cells 109*a* and 109*d*, respectively. Because the sides of tabs 201*a*-201*d* contact sides of their corresponding cells 109, transverse shifting of sock liner 200 relative to chassis 100 is prevented. Similarly, the fronts and rears of tabs 201*a*-201*d* contact the fronts and rears of their corresponding cells, thereby preventing longitudinal shifting of sock liner 200 relative to chassis 100.

Figure 8B:
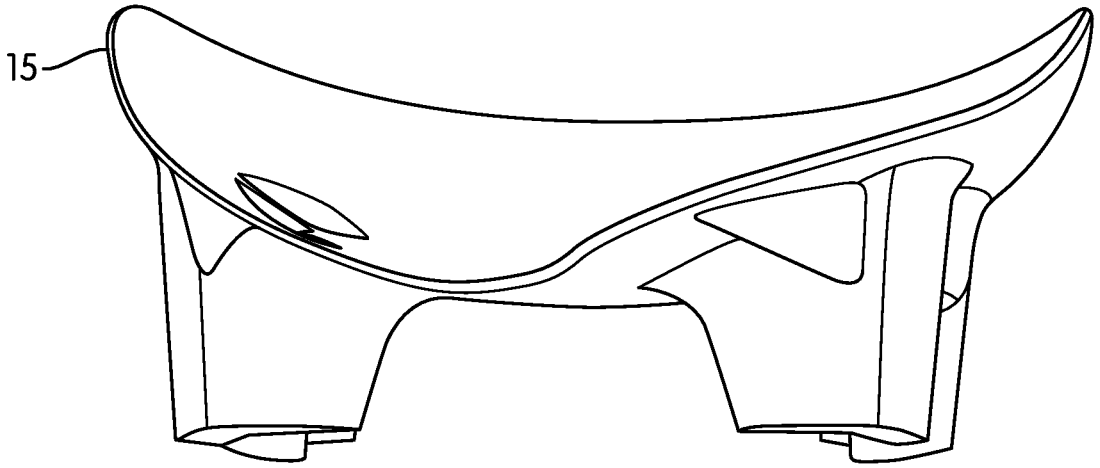
FIG. 8B is a partially schematic cross-sectional view, taken from the location indicated in FIG. 1A as sectioning plane 8-8, of a stud island of the sole structure of the shoe FIG. 1A.
Figure 8C:
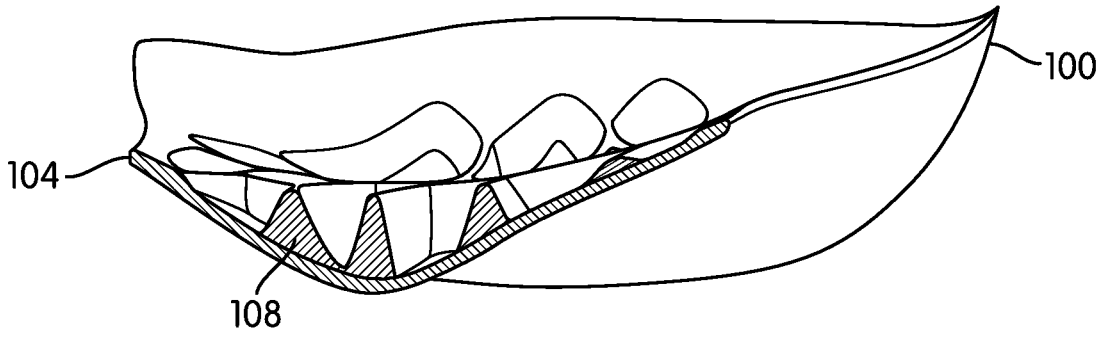
FIG. 8C is a partially schematic cross-sectional view, taken from the location indicated in FIG. 1A as sectioning plane 8-8, as well as from the location indicated in FIG. 4A as sectioning plane 8C-8C and rotated by 180°, of the chassis of the sole structure of the shoe of FIG. 1A.
Figure 8D:
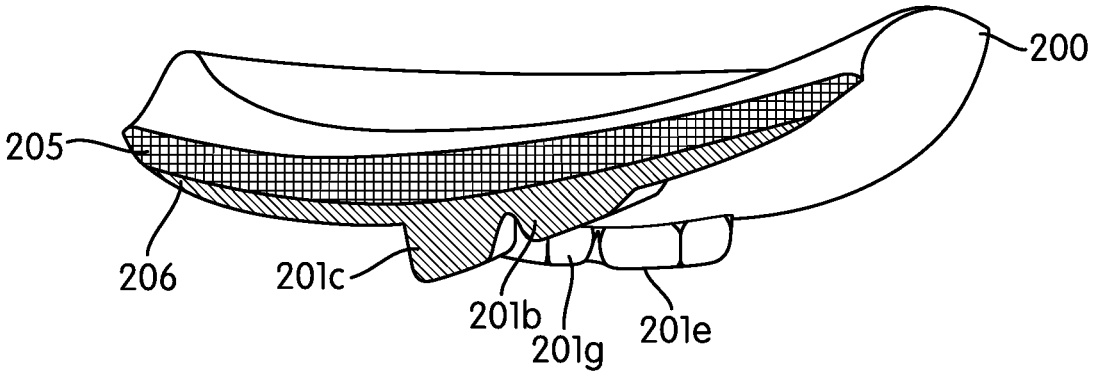
FIG. 8D is a partially schematic cross-sectional view, taken from the location indicated in FIG. 1A as sectioning plane 8-8, of the sock liner the sole structure of the shoe of FIG. 1A.

Additional details of the shoe 10 sole structure, relative to the cross-sectional plane on which FIG. 8A is based, can be seen in FIGS. 8B-8D. FIG. 8B is a cross-sectional view, taken from sectioning plane 8-8 (FIG. 1A), showing only stud island 15. FIG. 8C is a partially schematic cross-sectional view, taken from sectioning plane 8-8, showing only chassis 100. FIG. 8C is also a partially schematic cross-sectional view taken from the location indicated in FIG. 4A as sectioning plane 8C-8C and rotated by 180°. FIG. 8D is a partially schematic cross-sectional view, taken from sectioning plane 8-8, showing only sock liner 200. FIG. 8D is also a partially schematic cross-sectional view taken from the location indicated in FIG. 5B as sectioning plane 8D-8D.

Figure 8E:
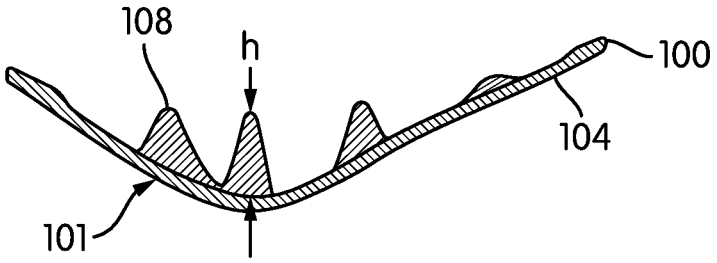
FIG. 8E is a partially schematic area cross-sectional view, taken from the location indicated in FIG. 1A as sectioning plane 8-8, as well as from the location indicated in FIG. 4A as sectioning plane 8C-8C and rotated by 180°, of the chassis of the sole structure of the shoe of FIG. 1A.

FIG. 8E is a partially schematic area cross-sectional view taken from sectioning plane 8-8 (FIG. 1A) and limited to chassis 100. FIG. 8E is also a partially schematic area cross-sectional view taken from sectioning plane 8C-8C (FIG. 4A) and rotated by 180°. As seen in FIG. 8E, walls 108 have even larger heights h in the arch midfoot region. In some embodiments, at least some walls 108 in an arch midfoot region corresponding to FIG. 8E have heights that are at least three times the corresponding thicknesses of base 104.

Figure 9A:
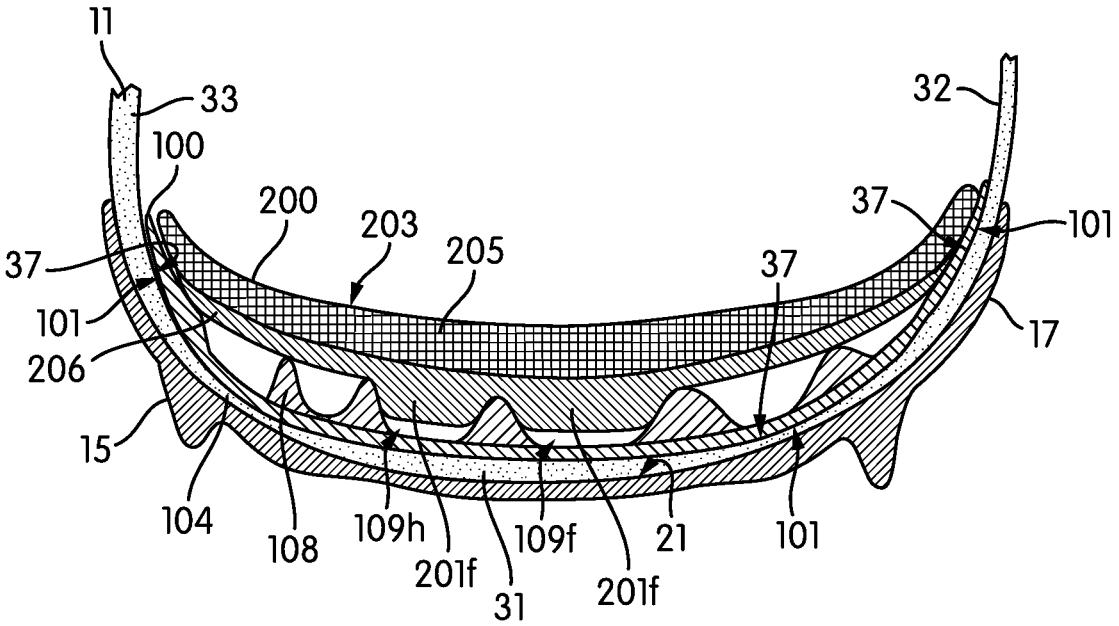
FIG. 9A is a partially schematic area cross-sectional view taken from the location indicated in FIG. 1A as sectioning plane 9-9.

FIG. 9A is a partially schematic area cross-sectional view of shoe 10 taken from the location indicated in FIG. 1A as sectioning plane 9-9. In FIG. 9A, portions of upper 11 have again been omitted for convenience. As in FIGS. 6A, 7A, and 8A, chassis 100 and sock liner 200 are positioned in the bottom of void 36, with bottom side 101 of chassis 100 bonded to the top surface 37 of plantar section 31, and with the bottom side of sock liner 200 resting against peaks of walls 108 of chassis 100. Top surface 21 of stud island 15 rear plate 17 is bonded to an exterior surface of plantar section 31.

FIG. 9A further shows the cooperation of tabs 201*f* and 201*h* with corresponding cells 109, in a manner similar to that described above for tabs 201*a*-201*d*, to restrain sock liner 200 from shifting relative to chassis 100. Tab 201*f* has a shape that corresponds to, and that nests snugly within, the top portion of cell 109*f*. Tab 201*h* has a shape that corresponds to, and that nests snugly within, the top portion of cell 109*h*. Tabs 201*e* and 201*g* similarly have shapes that correspond to, and that nest snugly within, the tops of cells 109*e* and 109*g*, respectively. As with tabs 201*a*-201*d*, tabs 201*e*-201*h* contact walls of cells 109*e*-109*h*, respectively, to prevent longitudinal and transverse shifting of sock liner 200 relative to chassis 100.

Figure 9B:
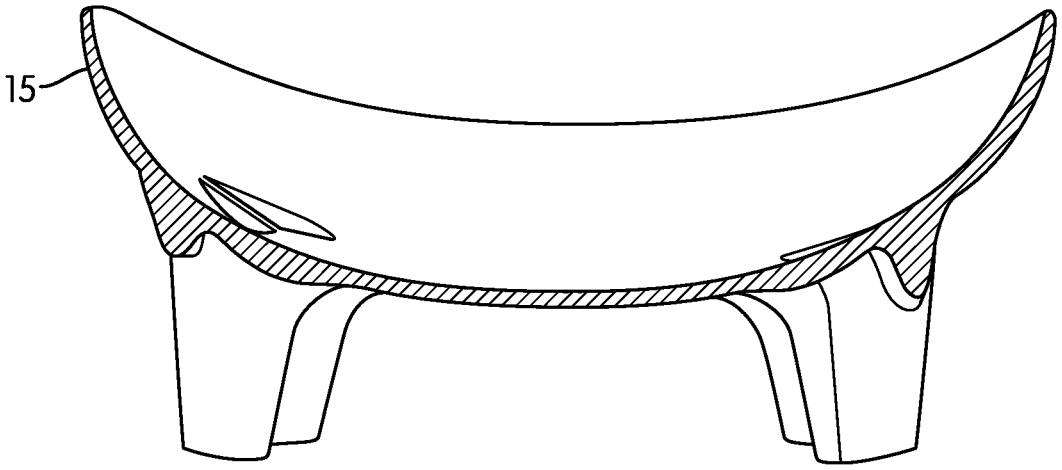
FIG. 9B is a partially schematic cross-sectional view, taken from the location indicated in FIG. 1A as sectioning plane 9-9, of a stud island of the sole structure of the shoe FIG. 1A.
Figure 9C:
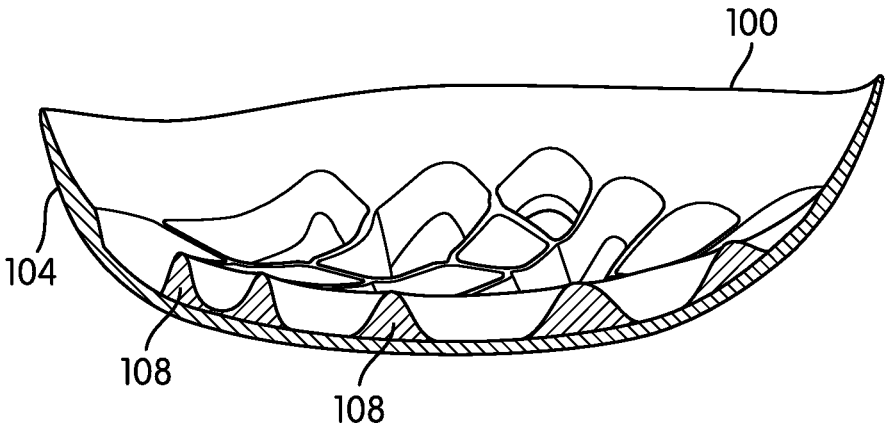
FIG. 9C is a partially schematic cross-sectional view, taken from the location indicated in FIG. 1A as sectioning plane 9-9, as well as from the location indicated in FIG. 4A as sectioning plane 9C-9C and rotated by 180°, of the chassis of the sole structure of the shoe of FIG. 1A.
Figure 9D:
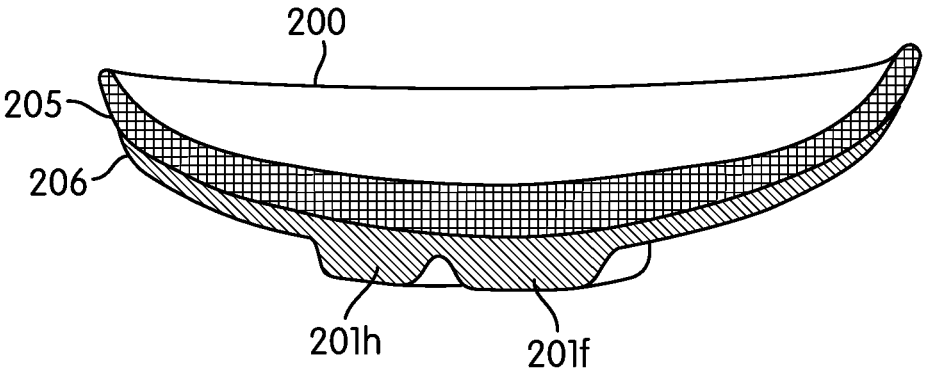
FIG. 9D is a partially schematic cross-sectional view, taken from the location indicated in FIG. 1A as sectioning plane 9-9, of the sock liner the sole structure of the shoe of FIG. 1A.

Additional details of the shoe 10 sole structure, relative to the cross-sectional plane on which FIG. 9A is based, can be seen in FIGS. 9B-9D. FIG. 9B is a partially schematic cross-sectional view, taken from sectioning plane 9-9 (FIG.

1A), showing only stud island 15. FIG. 9C is a partially schematic cross-sectional view, taken from sectioning plane 9-9, showing only chassis 100. FIG. 9C is also a partially schematic cross-sectional view taken from the location indicated in FIG. 4A as sectioning plane 9C-9C and rotated by 180°. FIG. 9D is a partially schematic cross-sectional view, taken from sectioning plane 9-9, showing only sock liner 200. FIG. 9D is also a partially schematic cross-sectional view taken from the location indicated in FIG. 5B as sectioning plane 9D-9D.

Figure 9E:
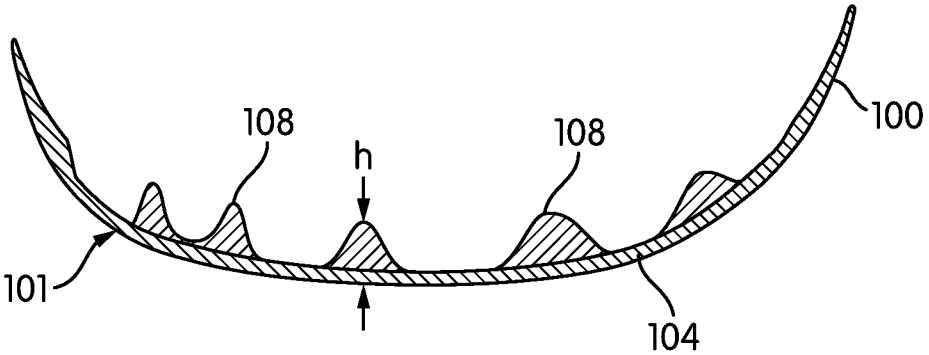
FIG. 9E is a partially schematic area cross-sectional view, taken from the location indicated in FIG. 1A as sectioning plane 9-9, as well as from the location indicated in FIG. 4A as sectioning plane 9C-9C and rotated by 180°, of the chassis of the sole structure of the shoe of FIG. 1A.

FIG. 9E is a partially schematic area cross-sectional view taken from sectioning plane 9-9 (FIG. 1A) and limited to chassis 100. FIG. 9E is also a partially schematic area cross-sectional view taken from sectioning plane 9C-9C (FIG. 4A) and rotated by 180°. As seen in FIG. 9E, walls 108 also have significant heights h in the heel region. In some embodiments, at least some walls 108 in a heel region corresponding to FIG. 9E have heights that are at least three times the corresponding thicknesses of base 104.

Figure 10:
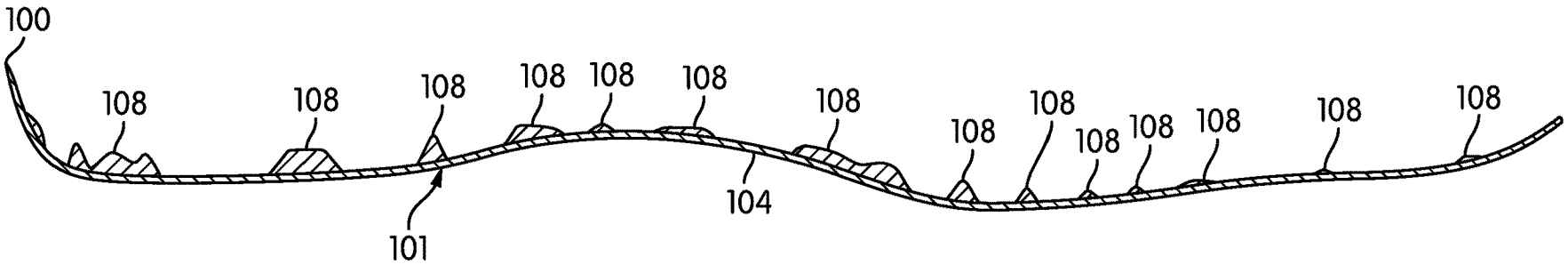
FIG. 10 is a partially schematic area cross-sectional view, taken along sectioning plane 10-10 indicated in FIG. 4A, of the chassis of the sole structure of the shoe of FIG. 1A.

FIG. 10 is a partially schematic area cross-sectional view of chassis 100 taken from the location indicated in FIG. 4A as sectioning plane 10-10.

Figure 11:
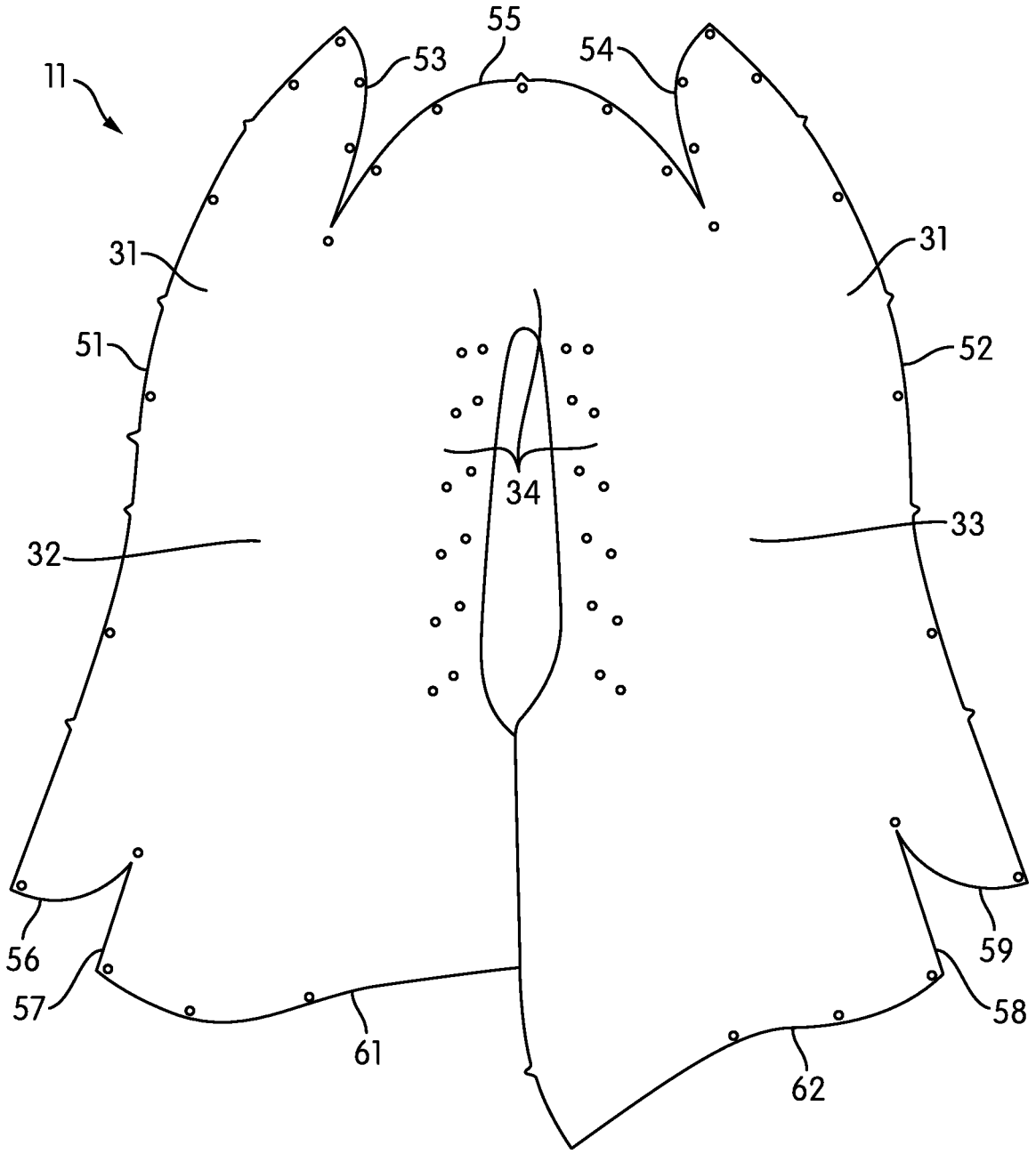
FIG. 11 is a top view of the upper of the shoe of FIG. 1A, in flattened form prior to assembly.

FIG. 11 is a top view of upper 11, according to some embodiments, in flattened form prior to assembly of shoe 10. The locations of plantar section 31, medial side section 32, lateral side section 33, and dorsal section 34 in flattened upper 11 are also indicated. When shoe 10 is assembled, edges 51 and 52 are joined to form the bottom of upper 11. Edges 53 and 54 are joined to corresponding portions of edge 55 to enclose the toe of upper 11. Edges 56 and 57 are joined, as are edges 58 and 59. Edges 61 and 62 are joined to enclose the rear of upper 11.

Figure 12:
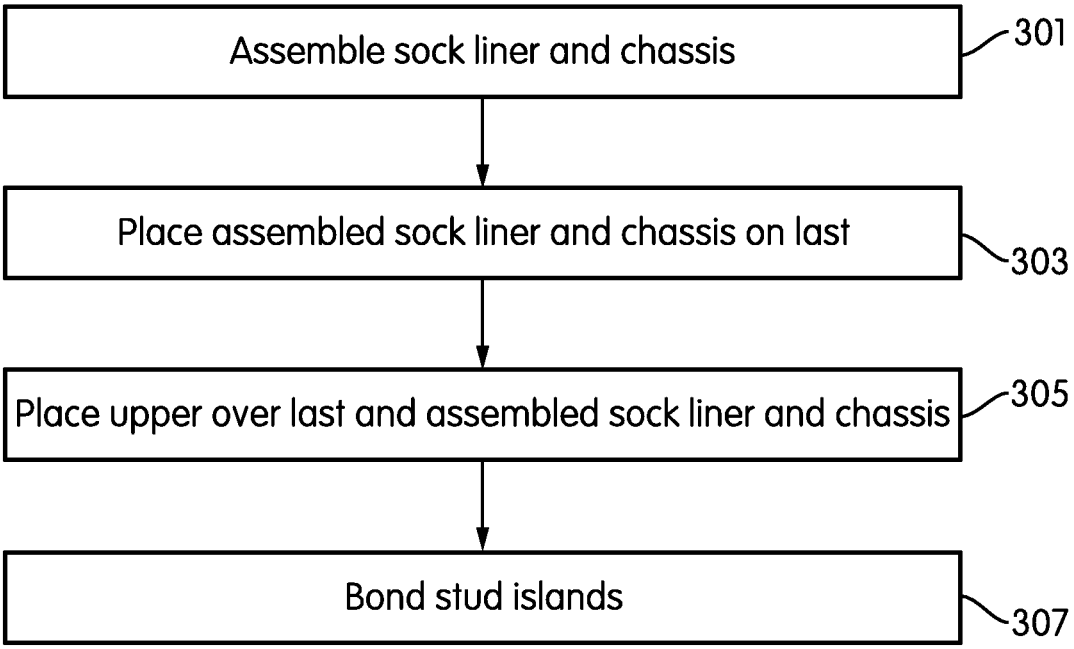
FIG. 12 is a flow chart showing steps in a method according to some embodiments.

FIG. 12 is a flow chart showing a method for assembly of shoe 10 according to some embodiments. In step 301, sock liner 200 and chassis 100 are assembled. As part of step 301, sock liner 200 is placed into chassis 100 so that tabs 201*a*-201*h* are located in cells 109*a*-109*h*, respectively, and so that the tops of walls 108 of chassis 100 are contacting the bottom side of sock liner 200. In step 303, assembled sock liner 200 and chassis 100 are placed onto a last so that top surface 203 of sock liner 200 is in contact with the bottom of the last, and so that bottom side 101 of chassis 100 is exposed. In step 305, upper 11 is then placed over the last and assembled sock liner 200 and chassis 100. Prior to or as part of step 305, the various edges of upper 11 are secured together as discussed above. Edges of upper 11 may be secured by, e.g., stitching. When upper 11 is placed over the last and assembled sock liner 200 and chassis 100, the seam between edges 51 and 52 may extend from toe to heel in roughly the center of chassis 100, and plantar section 31 is bonded to bottom side 101 of chassis 100. In step 307, stud islands 14 and 15 are bonded to the bottom of plantar section 31 of upper 11. Shoe 10 is then removed from the last.

Figure 13:
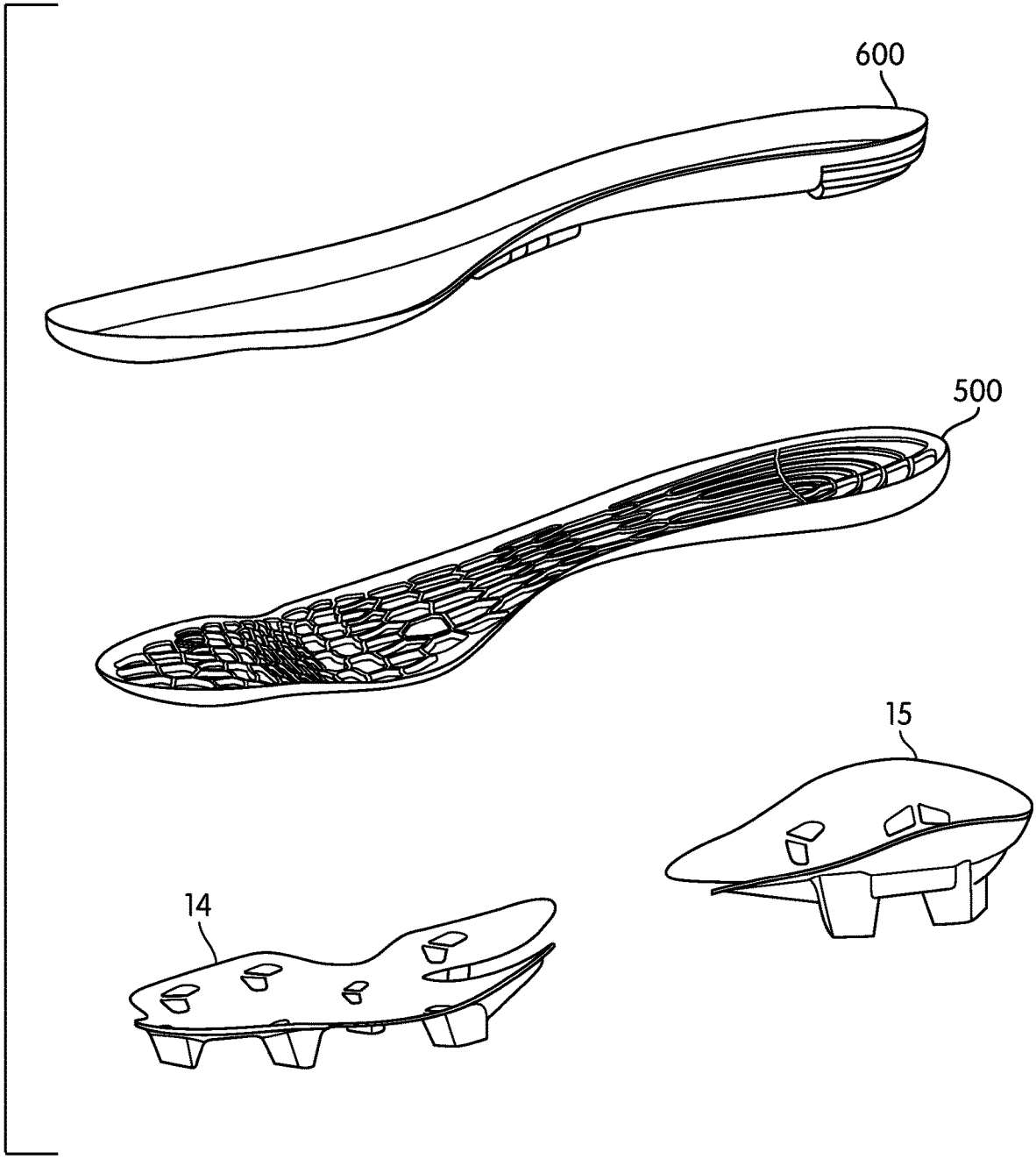
FIG. 13 is a top front medial perspective exploded view of a sole structure according to another embodiment.

FIG. 13 is a top front medial perspective view of a sole structure according to some additional embodiments. The sole structure of FIG. 13 includes stud islands 14 and 15 that are identical to stud islands 14 and 15 discussed above, a chassis 500, and a sock liner 600. The sole structure of FIG. 13 may be incorporated into a shoe in a manner similar to that described above for shoe 10. In particular, chassis 100 and sock liner 200 of shoe 10 could be replaced with chassis 500 and sock liner 600, respectively.

Figure 14A:
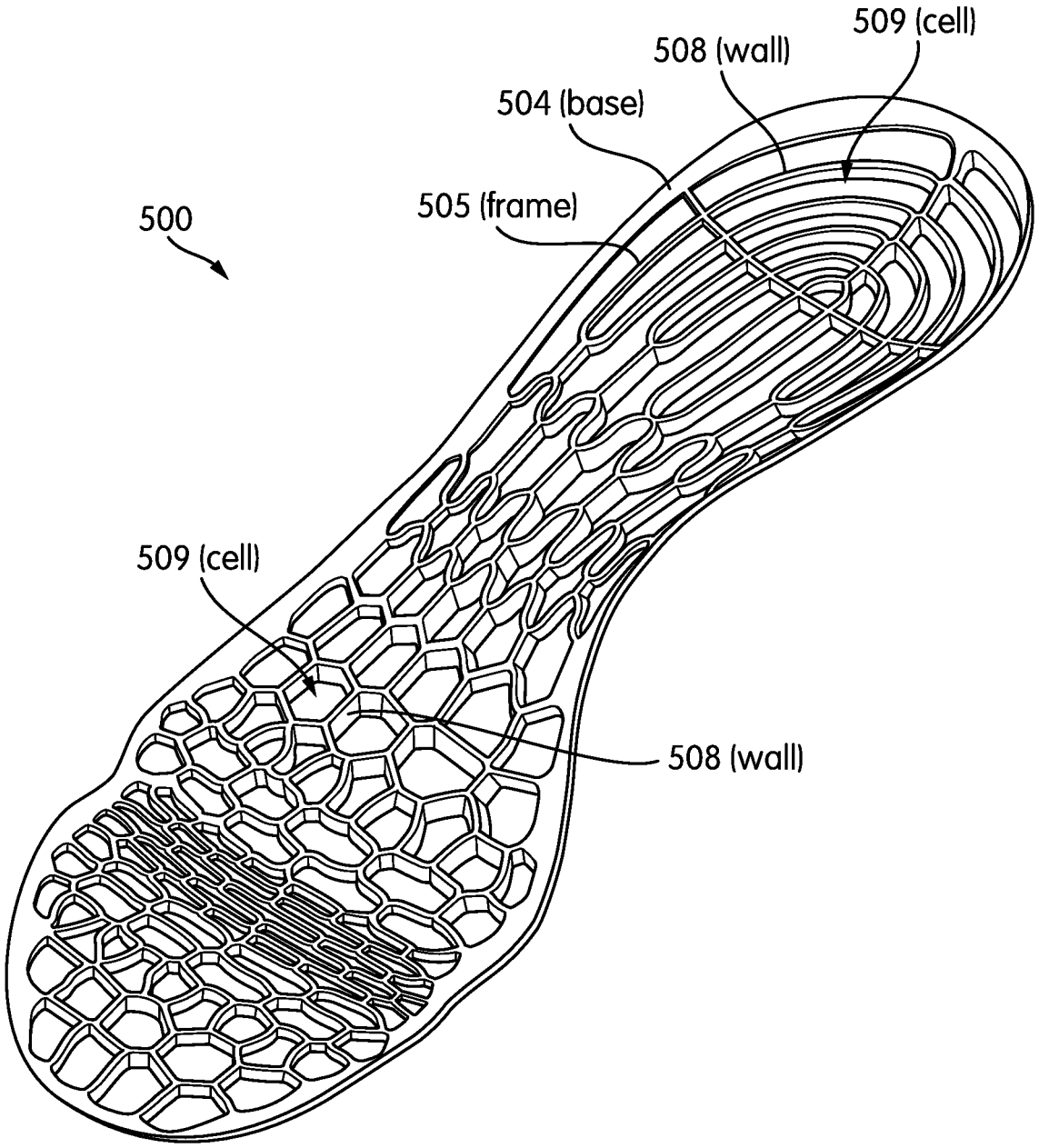
FIGS. 14A through 14D are respective top front medial perspective, top, bottom, and medial side views of a chassis of the sole structure of FIG. 13.

FIG. 14A is a top front medial perspective view of chassis 500. Similar to chassis 100, chassis 500 includes a frame 505 joined to a base 504. Frame 505 includes an interconnected network of walls 508 that define multiple cells 509.

Figure 14B:
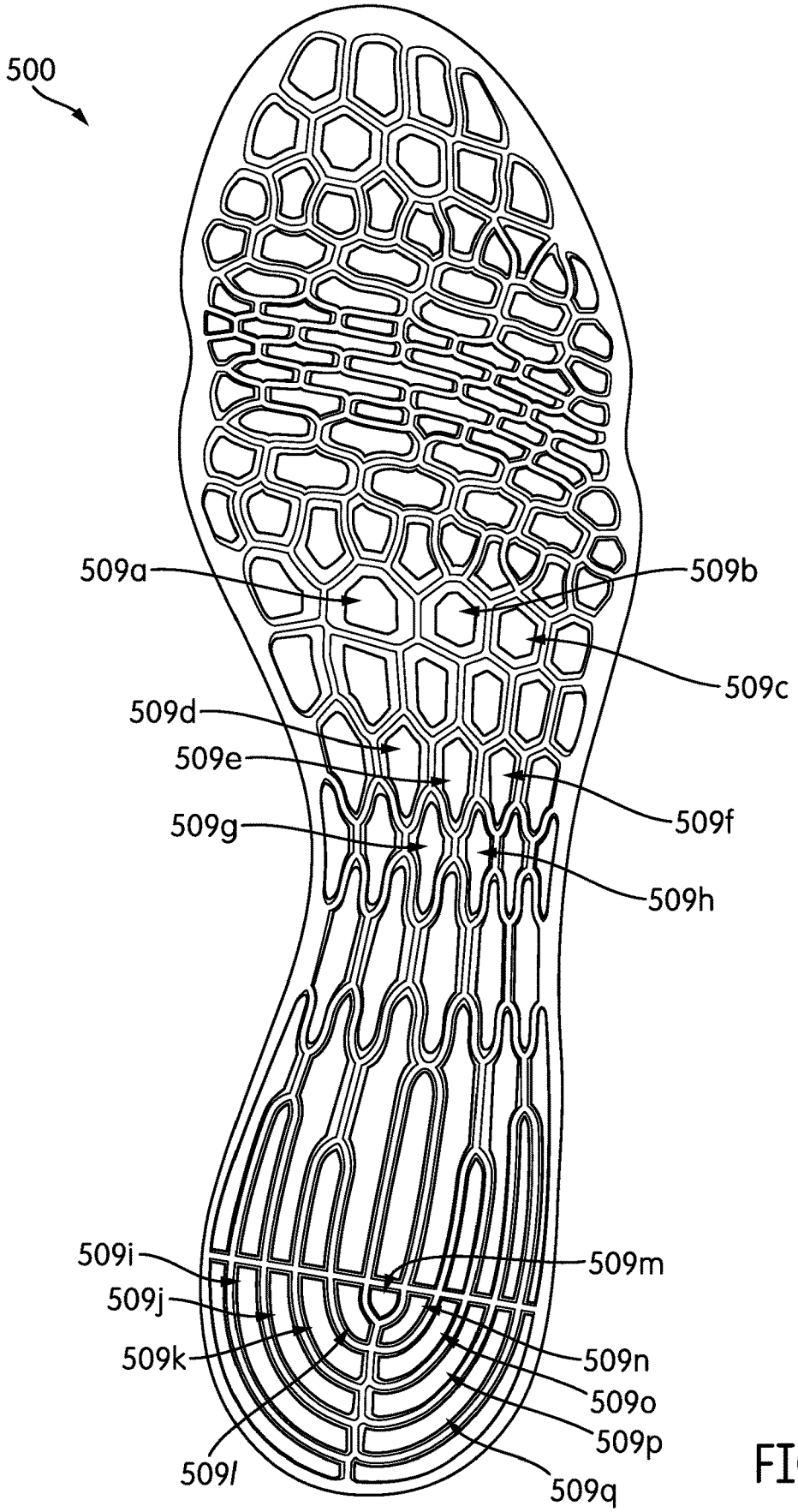
Figure 14C:
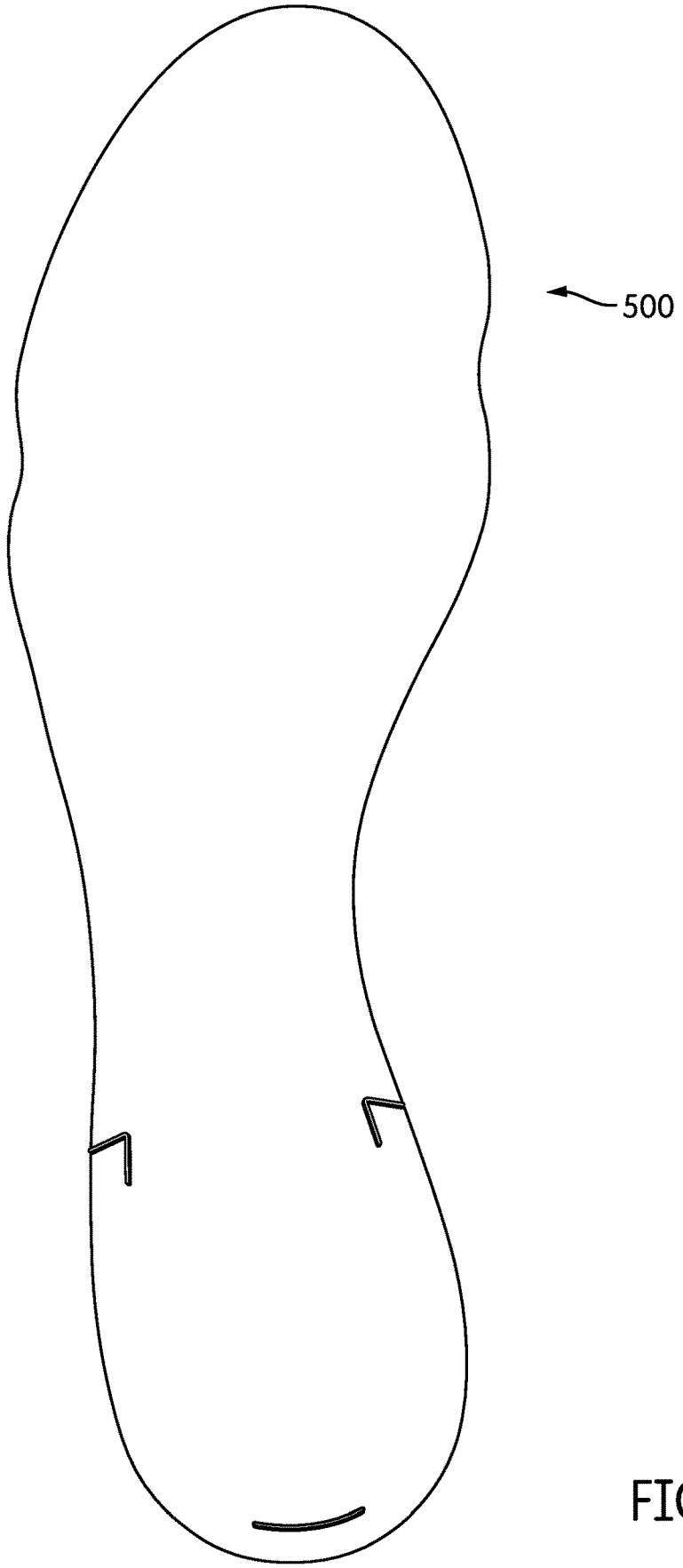
Figure 14D:
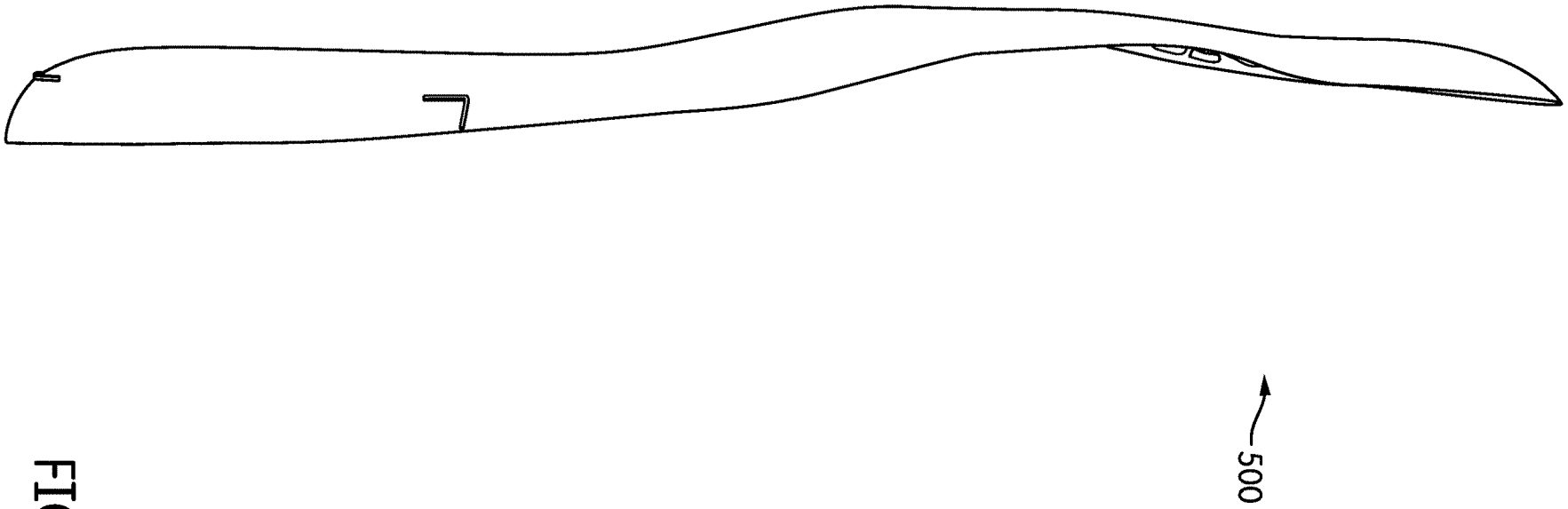

FIGS. 14B, 14C, and 14D are respective top, bottom, and medial side views of chassis 500. As seen in FIG. 14B, the shapes, sizes, and orientations of cells 509 vary throughout chassis 500. In the heel and rear midfoot regions, cells 509 are elongated and have orientations in which major axes of those cells point forwardly and laterally. In a forward midfoot region, cells 509 become less elongated. Cells 509 in rear and central forefoot regions have orientations in which major axes of those cells point forwardly and medially. Cells 509 in a phalangeal region become less elongated and larger, and have orientations in which major axes of those cells point forwardly and laterally. Similar to chassis 100, heights of walls 508 may be relatively small in forefoot regions, and may increase in midfoot and heel regions.

Figure 15:
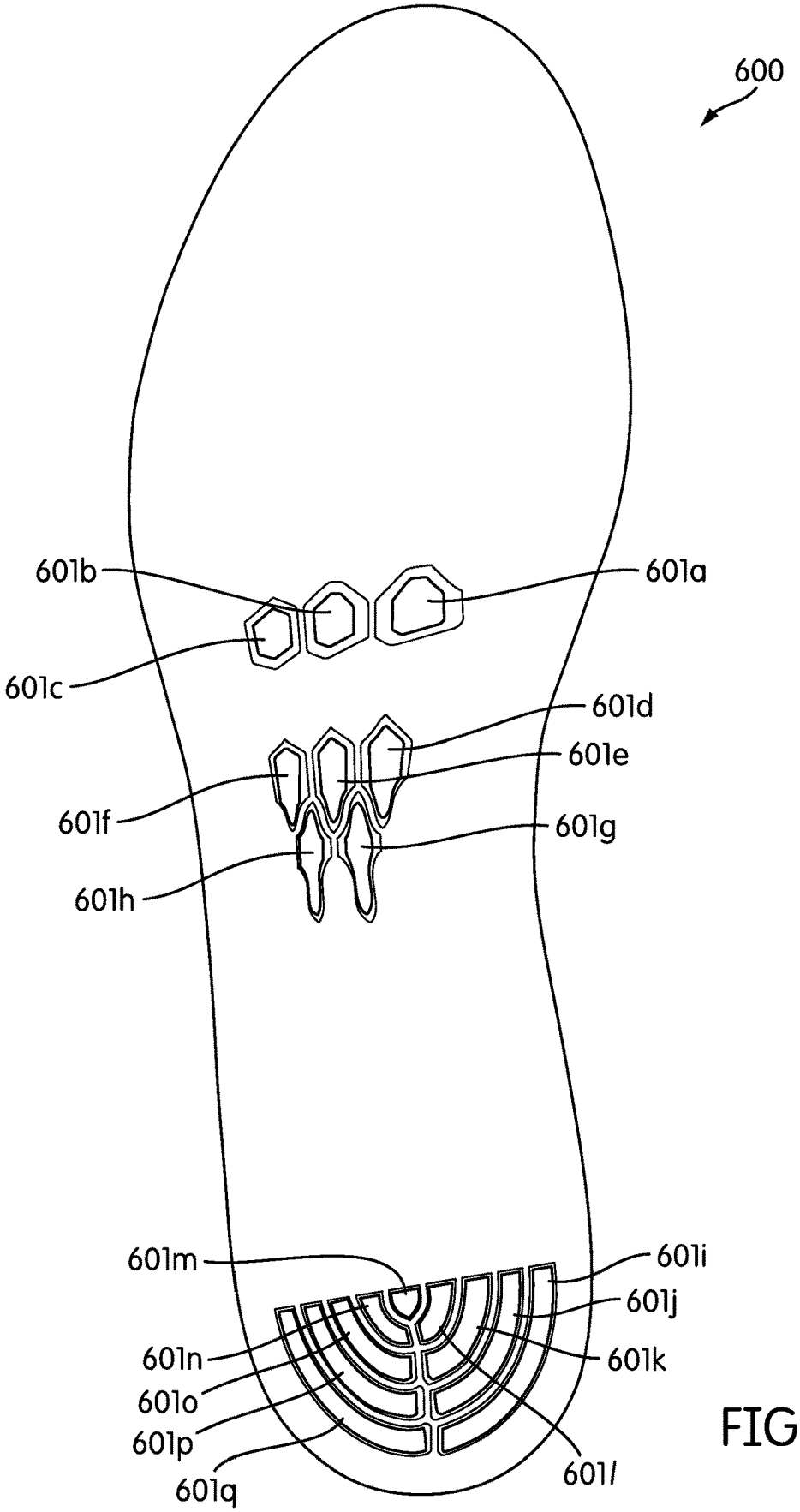
FIG. 15 is a bottom view of a sock liner of the sole structure of FIG. 13.

FIG. 15 is a bottom view of sock liner 600. The bottom side of sock liner 600 includes downwardly-extending tabs 601*a*-601*q* that correspond to cells 509*a*-509*q*, respectively, of chassis 500 (see FIG. 14B). Tabs 601*a*-601*q* cooperate with cells 509*a*-509*q* in a manner similar to that described above in connection with tabs 201*a*-201*h* and cells 109*a*-109*h*. Specifically, each of tabs 601*a*-601*q* has a shape that matches the internal volume of the upper portion of its corresponding cell. When a shoe that includes chassis 500 and sock liner 600 is assembled, each of tabs 601*a*-601*q* nests within its corresponding cell. In this manner, transverse and longitudinal shifting of sock liner 600 relative to chassis 500 is restricted.

Base 504 and frame 505 of chassis 500 may be formed from the same materials that may be used to form base 104 and frame 105, respectively, of chassis 100. Sock liner 600 may have a multilayer structure similar to that of sock liner 200 and be formed from similar materials. Chassis 500 and sock liner 600 each may be formed by injection molding. A shoe incorporating chassis 500 and frame 600 may have an upper similar to upper 11 and be assembled using a process similar to that described in connection with FIG. 12.

In some embodiments, a sock liner may have downwardly-extending tabs that cooperate with a support structure other than a chassis such as chassis 100 or chassis 500, and that restrain the sock liner from shifting relative to that other type of support structure. As but one example, a shoe could include an internal foam midsole instead of a chassis. Tabs on a sock liner may cooperate with depressions in the midsole.

Figure 16:
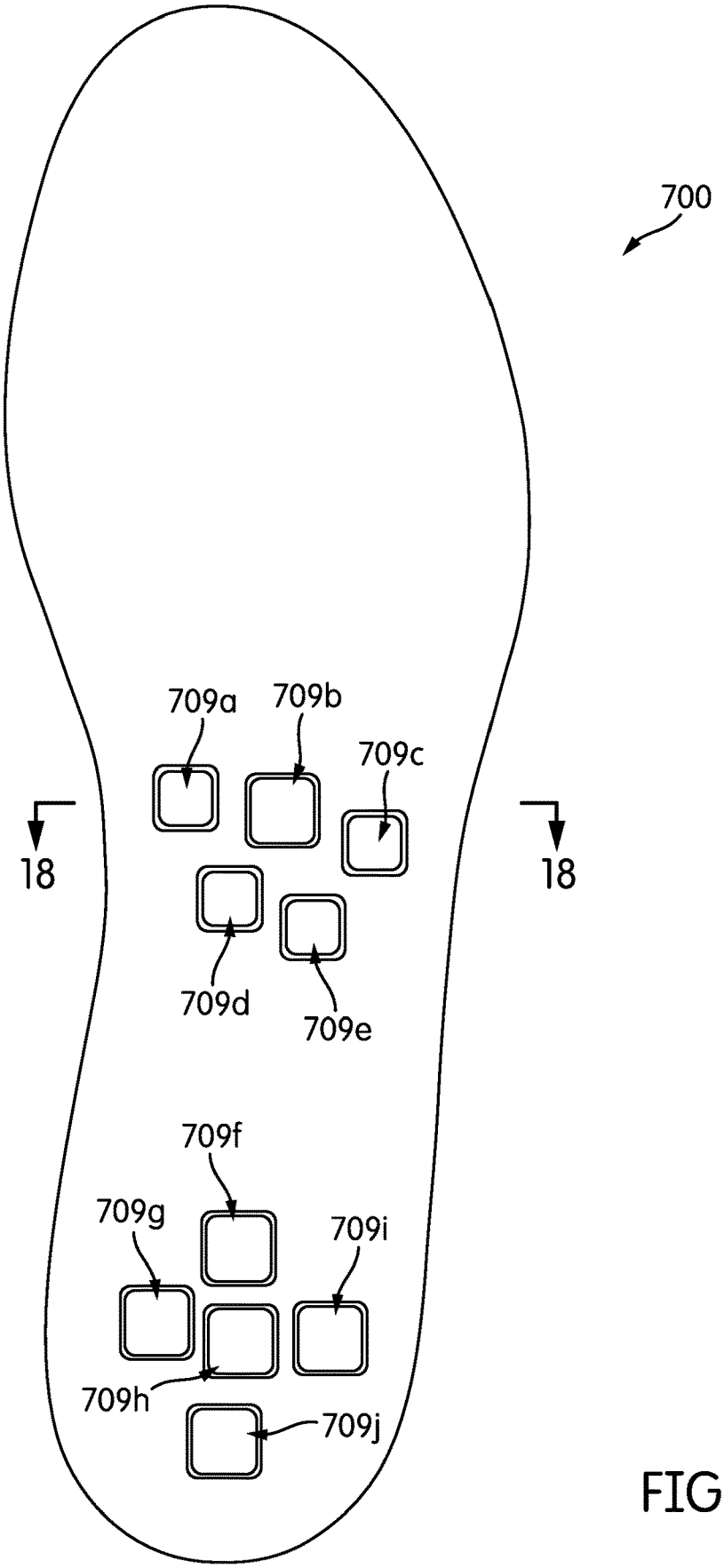
FIG. 16 shows the top side of a midsole according to some additional embodiments.

FIG. 16 shows the top side of a midsole 700 according to some such embodiments. Midsole 700 includes depressions 709*a*-709*j* formed in its top surface. Midsole 700 could be formed from, e.g., a closed cell polymer foam such as ethylene vinyl acetate (EVA).

Figure 17:
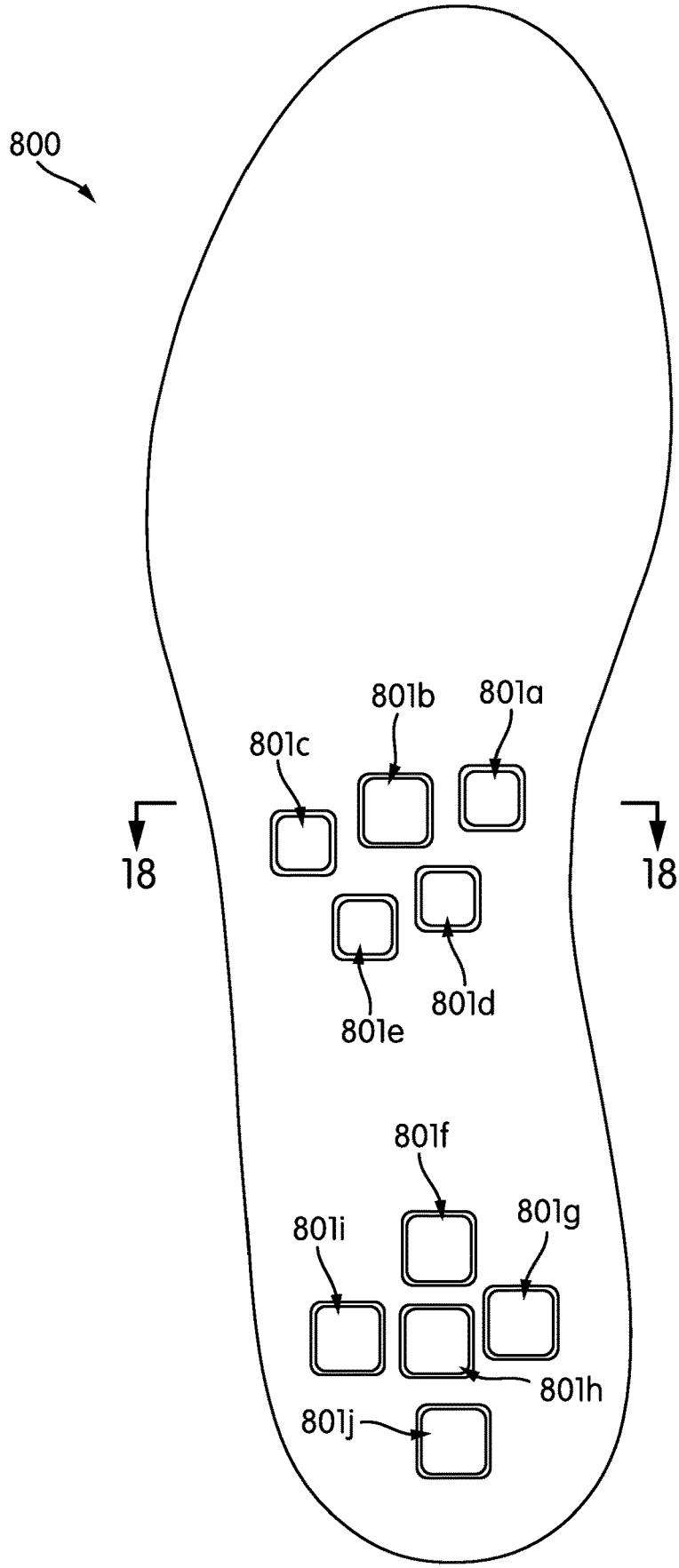
FIG. 17 shows the bottom side of a sock liner according to some additional embodiments.

FIG. 17 shows the bottom side of a sock liner 800 according to some embodiments. Downwardly extending tabs 801*a*-801*j* correspond to depressions 709*a*-709*j*, respectively, and cooperate with those depressions in a manner similar to that described above in connection with tabs 201*a*-201*h* and cells 109*a*-109*h*. Specifically, each of tabs 801*a*-801*j* has a shape that matches the internal volume of the upper portion of its corresponding depression. When a shoe that includes midsole 700 and sock liner 800 is assembled, each of tabs 801*a*-801*j* nests within its corresponding depression to prevent transverse and longitudinal shifting of sock liner 800 relative to midsole 700.

Figure 18:
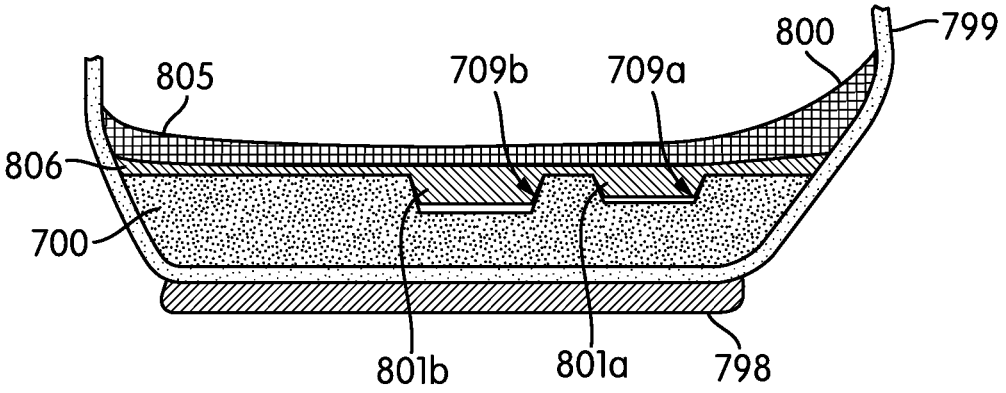
FIG. 18 is an area cross-sectional view of a shoe incorporating the midsole of FIG. 16 and the sock liner of FIG. 17.

FIG. 18 is a partially schematic area cross-sectional view of a shoe incorporating midsole 700 and sock liner 800. The view of FIG. 18 is taken through a transverse cross-sectional plane passing through tabs 801*a* and 810*b* and depressions 709*a* and 709*b*. The portion of FIG. 18 showing midsole 700 is an area cross-sectional view from the location indicated in FIG. 16 as sectioning plane 18-18 and rotated by 180°. The portion of FIG. 18 showing sock liner 800 is an area cross-sectional view from the location indicated in FIG. 17 as sectioning plane 18-18. Also shown in FIG. 18 are a portion of an upper 799 and a portion of an outsole 798. The bottom and sides of midsole 700 are bonded to corresponding inner surfaces of upper 799. Outsole 798 is bonded to an exterior portion of upper 799. Sock liner 800 has a two-layer construction, similar to that of sock liner 200, that includes an upper layer 805 and a lower layer 806. Layers 805 and 806, which may be bonded across the entirety of their interface, may be formed from material such as those described in connection with layers 205 and 206, respectively.

FIG. 18 also shows the cooperation of tabs 801*a* and 801*b* with corresponding depressions 709*a* and 709*b* to restrain sock liner 800 from shifting relative to midsole 700. Tab 801*a* has a shape that corresponds to, and that nests snugly within, the top portion of cell depression 709*a*. Tab 801*b* has a shape that corresponds to, and that nests snugly within, the top portion of depression 709*b*. Tabs 801*c* through 801*j* similarly have shapes that correspond to, and that nest snugly within, the tops of depressions 709*c* through 709*j*, respectively. Because the sides of tabs 801*a*-801*j* contact sides of their corresponding depressions 709, longitudinal and transverse shifting of sock liner 800 relative to midsole 700 is prevented.

Figure 19A:
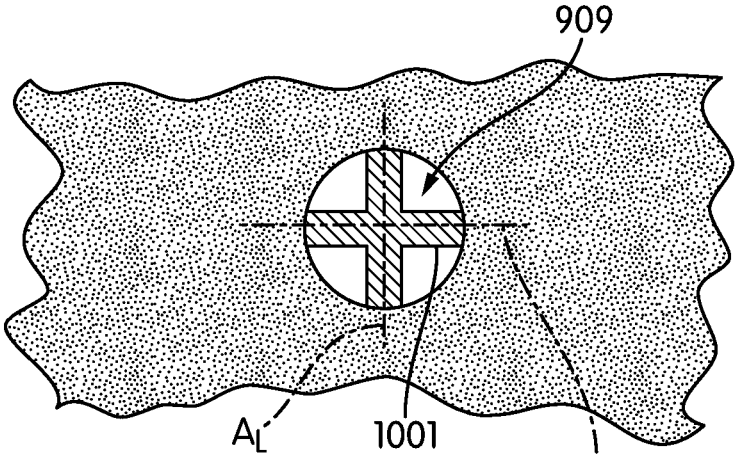
FIGS. 19A and 19B are partially schematic area cross-sectional views of sock liner tabs and corresponding support structure depressions according to additional embodiments.
Figure 19B:
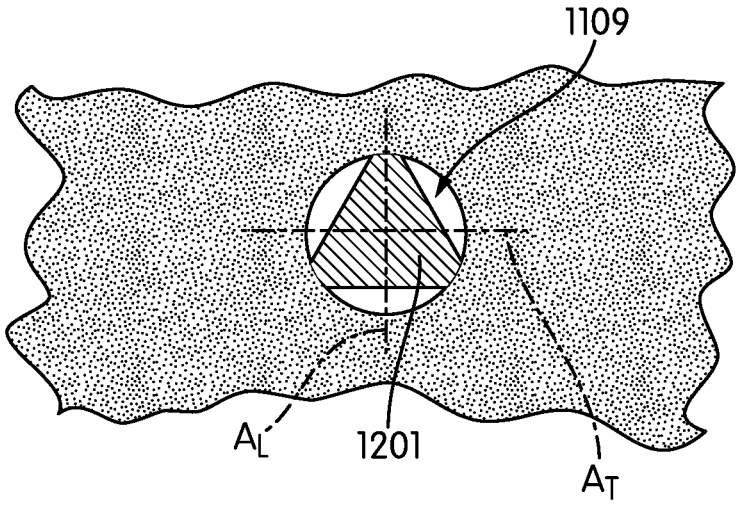

Although tabs 201*a*-201*h* and tabs 801*a*-801*j* have shapes that match the shapes of their corresponding cells or depressions, this need not be the case. In some embodiments, a tab may have a shape that is not the same as the shape of its corresponding cell or depression, but that nonetheless contacts walls of the depression at a minimum of two points that are displaced from one another along a longitudinal axis passing through the cell, depression, or other cavity, and at a minimum of two points that are displaced from one another along a transverse axis passing through the cell, depression, or other cavity. FIG. 19A is a partially schematic area cross sectional view showing one example. The view of FIG. 19A is in a horizontal plane passing through a support structure depression 909 and a sock liner tab 1001. A similar cross-section of the embodiment of FIG. 18 would be taken from a plane extending out of the page of FIG. 18 and passing through tabs 801*a* and 801*b*. Also shown in FIG. 19A are longitudinal and transverse axes $A_L$ and $A_T$, respectively. FIG. 19B is a partially schematic area cross sectional view showing another example. The view of FIG. 19B is in a horizontal plane passing through a support structure depression 1109 and a sock liner tab 1201.

Other embodiments include numerous additional variations on the components and combinations described above. Without limitation, such variations may include one or more of the following.

In some embodiments, studs or other traction elements may be attached in a different manner. In some embodiments, for example, studs may not be joined to an island and may be individual attached. As another example, studs may also or alternatively be attached using mechanical fasteners. For example, a socket could be formed in or attached to chassis 100, and the portion of upper 11 over the opening to that socket could be removed (or omitted). A stud could include a post that is received into the socket. As yet another example, studs, a stud island, and/or other components could be directly molded onto an exterior surface of plantar section 31 after upper 11 has been bonded to chassis 100.

Figure 20:
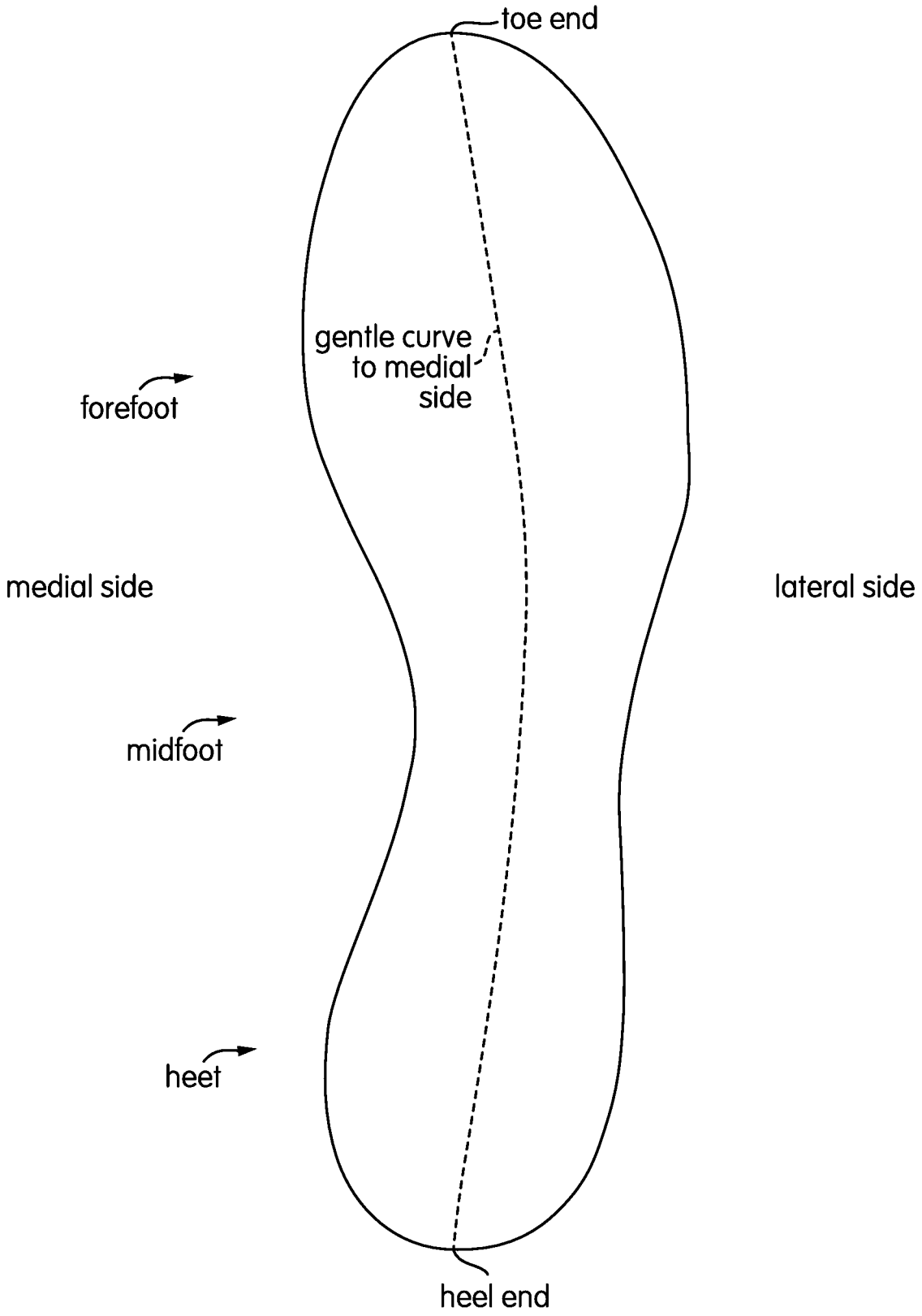
FIG. 20 is a non-limiting example of a footwear sole shape.

A chassis and/or its base may a footwear sole shape that varies from the shape shown in FIG. 4A. In general, a footwear sole structure shape may have a heel region, a midfoot region, and a forefoot region, a heel end at a rear-most part of the heel region, a toe end at a forward-most part of the forefoot region, a medial side, and a lateral side. The heel region may be narrower than a central portion of the forefoot region. A path from the heel end to the toe that remains generally equidistant from the medial and lateral sides may have a gentle curve toward the medial side. The forefoot region may have a rounded taper toward the toe end. Optionally the shape may be pinched inward on the medial and/or lateral sides in the midfoot region. A non-limiting example of a generic footwear sole shape is shown in FIG. 20.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and their practical application to enable one skilled in the art to utilize the present invention in various embodiments and with various modifications as are suited to the particular use contemplated. Any and all combinations, subcombinations and permutations of features from herein-described embodiments are the within the scope of the invention. In the claims, a reference to a potential or intended wearer or a user of a component does not require actual wearing or using of the component or the presence of the wearer or user as part of the claim.

The invention claimed is:

1. An article of footwear, comprising:

an upper, the upper comprising a plantar section, side sections, and a dorsal section, the plantar, side and dorsal sections defining a void;

a chassis comprising a base and a frame, wherein the chassis is located in a bottom of the void, a bottom side of the base is fixed relative to a top surface of the plantar section, the frame is disposed at a top side of the base, and the frame comprises a network of interconnected walls defining a plurality of cells, each of at least a portion of the cells having a bottom closed by an underlying portion of the base; and a sock liner within the void and resting on a top of the chassis, and wherein a bottom of the sock liner includes downwardly-extending tabs, each of the tabs extending into a corresponding one of the cells to secure the sock liner from transverse and longitudinal movement relative to chassis.

2. The article of footwear of claim 1, comprising one or more studs positioned on an exterior side of the plantar section.

3. The article of footwear of claim 1, wherein the base and the frame are formed from one or more polymeric materials.

4. The article of footwear of claim 1, wherein the bottom side of the base is bonded to the top surface of the plantar section.

5. The article of footwear of claim 1, wherein tops of at least some of the cells are open.

6. The article of footwear of claim 1, wherein the base has a peripheral edge having a shape of a sole of the article of footwear.

7. The article of footwear of claim 1, wherein the base and/or the frame extend through heel, midfoot and forefoot regions of the void.

8. The article of footwear of claim 1, wherein at least some of the cells are varied with respect to at least one of size, shape, orientation, and spacing, and wherein at least some of the walls are varied with respect to wall height and wall thickness, so as to define one or more regions having a first stiffness and one or more regions having a second stiffness less than the first stiffness.

9. The article of footwear of claim 1, wherein the base is formed from a first material and the frame is formed from a second material different from the first material, and wherein the first material is softer than the second material.

10. The article of footwear of claim 1, wherein a first set of the cells is located in at least a heel region, each of the cells of the first set being oriented with its major axis pointing forward and laterally, and a second set of the cells is located in at least a portion of the forefoot region, each of the cells of the second set being oriented with its major axis pointing forward and medially.

11. The article of footwear of claim 10, wherein the first set of cells extends into central and rear arch regions, and a third set of the cells is located in a phalangeal region, each of the cells of the third set being oriented with its major axis pointing forwardly, forwardly and laterally, or forwardly and medially.

12. The article of footwear of claim 1, wherein walls of the frame in a forefoot region have heights that are less than or equal to a corresponding thickness of the base in the forefoot region.

13. The article of footwear of claim 1, wherein walls of the frame in a midfoot region have heights that are at least 3 times a corresponding thickness of the base in the midfoot region.

14. The article of footwear of claim 1, wherein walls of the frame in a heel region have heights that are at least 3 times a corresponding thickness of the base in the heel region.

15. The article of footwear of claim 1, wherein each of the tabs has a perimeter shape matching a perimeter shape of the cell corresponding to the tab.

16. The article of footwear of claim 1, wherein each of the tabs has a shape that contacts the sides of the cell corresponding to the tab in at least two longitudinally displaced locations and at least two transversely displaced locations.

17. The article of footwear of claim 1, wherein the tabs are located in heel and central arch regions.

18. The article of footwear of claim 1, wherein the sock liner has bottom and top layers, and wherein the bottom layer is more dense and/or less compressible than the top layer.

19. An article of footwear, comprising:

an upper, the upper comprising a plantar section, side sections, and a dorsal section, the plantar, side and dorsal sections defining a void;

a support surface located in a bottom of the void and having a top side, the support surface top side having a plurality of upwardly open cavities formed therein;

a sock liner within the void and resting on the top side of the support surface, wherein a bottom of the sock liner includes downwardly extending tabs, each of the tabs extending into a corresponding one of the cavities to secure the sock liner from transverse and longitudinal movement relative to support surface;

a base having a peripheral edge, the peripheral edge having a footwear sole shape; and a frame comprising the support surface and disposed at a top side of the base, the frame comprising a network of interconnected walls defining a plurality of cells, each of at least a portion of the cells having a bottom closed by an underlying portion of the base, wherein a first set of the cells is located in at least a heel region, each of the cells of the first set being oriented with its major axis pointing forward and laterally, and a second set of the cells is located in at least a portion of a forefoot region, each of the cells of the second set being oriented with its major axis pointing forward and medially.

20. The article of footwear of claim 19, wherein the footwear sole shape comprises the heel region, a midfoot region, and the forefoot region, a heel end at a rear-most part of the heel region, a toe end at a forward-most part of the forefoot region, a medial side, and a lateral side, the heel region is narrower than a central portion of the forefoot region, a path from the heel end to the toe end that remains generally equidistant from the medial and lateral sides has a curve toward the medial side, and the forefoot region has a rounded taper toward the toe end.

21. The article of footwear of claim 19, wherein the base and the frame are formed from one or more polymeric materials, and wherein tops of at least some of the cells are open.

22. The article of footwear of claim 19, wherein at least some of the cells are varied with respect to at least one of size, shape, orientation, and spacing, and wherein at least some of the walls are varied with respect to wall height and wall thickness, so as to define one or more regions having a first stiffness and one or more regions having a second stiffness less than the first stiffness.

23. The article of footwear of claim 19, wherein the base is formed from a first material and the frame is formed from a second material different from the first material, and wherein the first material is softer than the second material.

24. The article of footwear of claim 19, wherein the cells of the first set extend into central and rear arch regions, and a third set of the cells is located in a phalangeal region, each of the cells of the third set being oriented with its major axis pointing forwardly, forwardly and laterally, or forwardly and medially.

25. The article of footwear of claim 19, wherein a portion of the cells comprise the corresponding cavities into which the tabs extend.

26. The article of footwear of claim 19, wherein each of the tabs has a perimeter shape matching a perimeter shape of the cavity corresponding to the tab.

27. The article of footwear of claim 19, wherein the tabs are located in heel and central arch regions.

* * * * *